US005991571A

United States Patent [19]

Yamada et al.

[11] Patent Number: 5,991,571

[45] Date of Patent: Nov. 23, 1999

[54] CYLINDRICAL MEMBER AND ENGAGEMENT MEMBER ASSEMBLY

[75] Inventors: Yusuke Yamada, Numazu; Tomohiro Kimura, Kawasaki, both of Japan

[73] Assignee: Canon Kabushiki Kaisha, Tokyo, Japan

[21] Appl. No.: 08/941,630

[22] Filed: Sep. 30, 1997

[30] Foreign Application Priority Data

Sep. 30, 1996 [JP] Japan ..... 8-278964
Sep. 24, 1997 [JP] Japan ..... 9-258520

[51] Int. Cl.[6] ..... G03G 15/00

[52] U.S. Cl. ..... 399/117; 29/895.22; 399/279

[58] Field of Search ..... 399/116, 117, 399/159, 279, 265; 492/16–18; 29/895.22

[56] References Cited

U.S. PATENT DOCUMENTS 1,092,464 4/1914 Watson et al. .
2,429,293 10/1947 Peck et al. .
4,344,218 8/1982 Hooper et al. .
4,561,763 12/1985 Basch ..... 399/116
5,151,734 9/1992 Tsuda et al. ..... 399/111
5,229,813 7/1993 Cherian ..... 399/164
5,675,893 10/1997 Yamada et al. ..... 29/895.22
5,739,900 4/1998 Isobe ..... 399/109
5,771,425 6/1998 Yamada et al. ..... 399/111

FOREIGN PATENT DOCUMENTS 0 528 568 2/1993 European Pat. Off. .
5-150533 6/1993 Japan .
6-264920 9/1994 Japan .

*Primary Examiner*—Robert Beatty
*Attorney, Agent, or Firm*—Fitzpatrick, Cella, Harper & Scinto

[57] ABSTRACT

An electrophotographic image forming apparatus includes a cylindrical member having a thin portion at a longitudinal end thereof and an engaging member being mounted as fitted to an internal surface of the longitudinal end of the cylinder and having a depressed portion corresponding to the thin portion of the cylinder. The engaging member is attached to the cylinder by bending the thin portion of the cylinder toward the depressed portion.

63 Claims, 17 Drawing Sheets

CYLINDRICAL MEMBER AND ENGAGEMENT MEMBER ASSEMBLY

BACKGROUND OF THE INVENTION

1. Field of the Invention

The present invention relates to a cylindrical member, an electrophotographic photosensitive drum, a developing roller, and a process cartridge.

The cylindrical member, the electrophotographic photosensitive drum, and the developing roller are used in an electrophotographic image forming apparatus. The electrophotographic image forming apparatus forms an image on a recording medium by an electrophotographic image forming method. Examples of an electrophotographic image forming apparatus include electrophotographic copiers, electrophotographic printers (for example, laser beam printers, LED printers, etc.), facsimile machines, word processors, and so on.

2. Related Background Art

The conventional electrophotographic image forming apparatus employing the electrophotographic image forming process uses cylindrical members such as an electrophotographic photosensitive drum or the developing roller. An engaging member so called as a drum flange or the like is attached to an end of these cylindrical members.

An example of the electrophotographic photosensitive drum will be described as a typical example. This electrophotographic photosensitive drum is constructed in such an arrangement that the engaging member, e.g., a drum gear and a drum flange, for receiving a driving force for rotating the photosensitive drum is coupled with an end of a cylinder, the surface of which is coated with a photosensitive, electroconductive material.

A method for coupling the cylinder with the engaging member is the method shown in European Patent Publication No. 0 528 568 Al, in which the engaging member provided with a depression is inserted into the end of a cylinder. Then the end of the cylinder is cut and bent to achieve coupling.

Another method is the method shown in Japanese Laid-open Patent Application No. 6-264920, in which the internal surface of the cylinder is first subjected to the spigot joint processing. Then, the engaging member is engaged with the internal surface of the cylinder. Then, the cylinder is cut and bent at a plurality of portions thereof to engage the cut and bent portions with a depression of the engaging member.

SUMMARY OF THE INVENTION

An object of the present invention is to provide a cylindrical member, an electrophotographic photosensitive drum, a developing roller, and a process cartridge, improved in the transmitting the coupling force between the cylinder and the engaging member.

Anther object of the present invention is to provide a cylindrical member, an electrophotographic photosensitive drum, a developing roller, and a process cartridge, improved in cylindricity.

Still another object of the present invention is to provide a cylindrical member, an electrophotographic photosensitive drum, a developing roller, and a process cartridge incorporating the foregoing, either one of the cylindrical member, the electrophotographic photosensitive drum, and the developing roller comprising a cylinder, the cylinder having a thin portion of a small thickness at a longitudinal end; and an engaging member, the engaging member being fitted to an internal surface of the longitudinal end of the cylinder and being provided with a depression corresponding to the thin portion of the cylinder; wherein the engaging member is attached to the cylinder by bending the thin portion of the cylinder into the depression.

The other objects and features of the present invention will become more apparent by the detailed description below with reference to the accompanying drawings.

DESCRIPTION OF THE PREFERRED EMBODIMENTS

Figure 1:
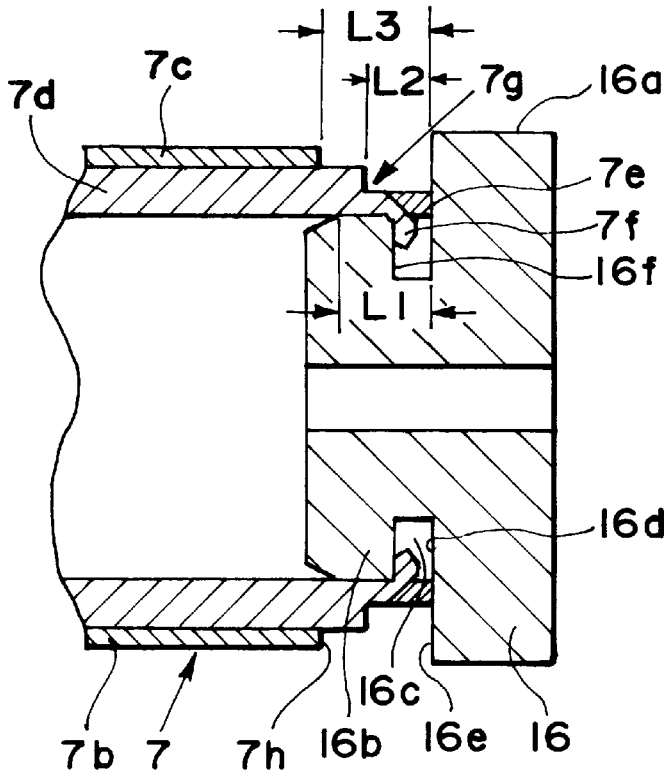
FIG. 1 is a longitudinal, cross-sectional view of a photosensitive drum according to an embodiment of the present invention.

The present invention will be described referring to the drawings with examples of the electrophotographic photosensitive drum (as will be referred to as "photosensitive drum") and the developing roller as cylindrical members. (Cylindrical member)

FIG. 1 is a cross-sectional view of a photosensitive drum according to an embodiment of the present invention. In the present embodiment the photosensitive drum 7 has gear flange 16 as a drum flange. This gear flange 16 is coupled with an end of drum cylinder 7*d* and has drum gear 16*a* in the peripheral surface thereof. This gear flange 16 receives a driving force from the main body of the apparatus. This gear flange 16 is for supporting the photosensitive drum 7 on a frame and for rotating the photosensitive drum 7. The gear flange 16 is provided with a cylindrical fitting portion 16*b* for fitting with the drum cylinder 7*d* of a hollowed cylinder shape. In this fitting portion 16*b* there are a plurality of depressions 16*c* formed at intervals in the peripheral surface thereof. The drum cylinder 7*d* has a photosensitive layer 7*b* of a photoconductive layer as a coating of photosensitive substance on the peripheral surface thereof. The drum cylinder 7*d* is fitted with the fitting portion 16*b* of the gear flange 16 with a predetermined fitting tolerance. Further, a stepped portion 7*g* is provided at the end of the drum cylinder 7*d*.

The axial length L2 of the stepped portion 7*g* is shorter than the axial length L1 of a portion of the fitting portion 16*b* in contact with the drum cylinder 7*d*. An intermediate portion 7*c* of the drum cylinder 7*d* has constant inside and outside diameters throughout the entire length thereof. The stepped portion 7*g* has the same inside diameter as the intermediate portion 7*c* and the outside diameter of the stepped portion 7*g* is smaller than that of the intermediate portion 7*c*. Therefore, the thickness of the stepped portion 7*g* (thin portion) is smaller than that of the intermediate portion 7*c*. When a shear force is applied perpendicular to the axis of drum cylinder 7*d*, no influence is caused by the thinner arrangement of the stepped portion 7*g* than the intermediate portion 7*c* and strength and rigidity is kept sufficient.

A cross section of the depression 16*c* by a plane including the axis of gear flange 16 is rectangular. In the cross section, two opposed sides are parallel to a plane perpendicular to the axis of gear flange 16.

In the assembled state, an end face 7*e* of the drum cylinder 7*d* is in contact with a side face 16*e* of the gear flange 16. Parts of the stepped portion 7*g* are cut in parallel to the axial direction and bent, thereby forming cut and bent (lanced and bent) portions 7*f*. The cut and bent portions 7*f* are fitted just in the depressions 16*c* in the circumferential direction and are in contact with caulking receiving faces 16*f* of the depressions 16*c* perpendicular to the axis. Caulking flanks 16*d* opposite to the caulking receiving faces 16*f* of the depressions 16*c* are on the same plane as the side face 16*e* of the gear flange 16 in this example.

Figure 2:
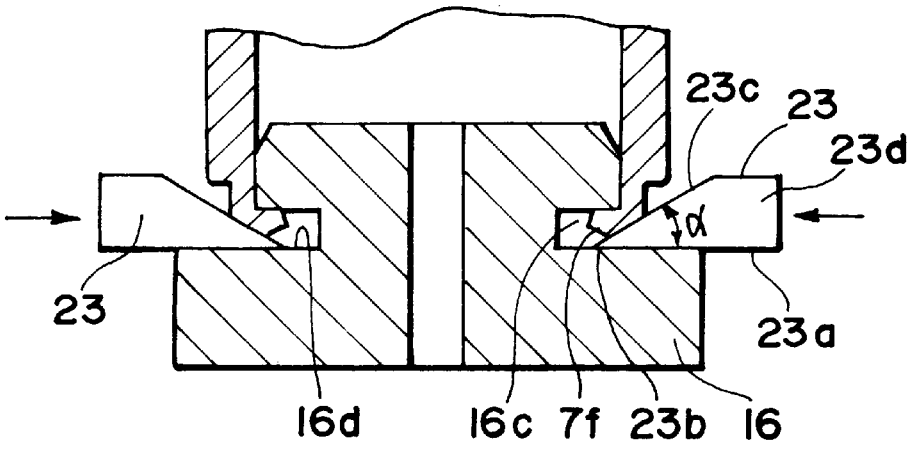
FIG. 2 is a longitudinal, cross-sectional view of an end of a cylinder in a cut and bend step.
Figure 3:
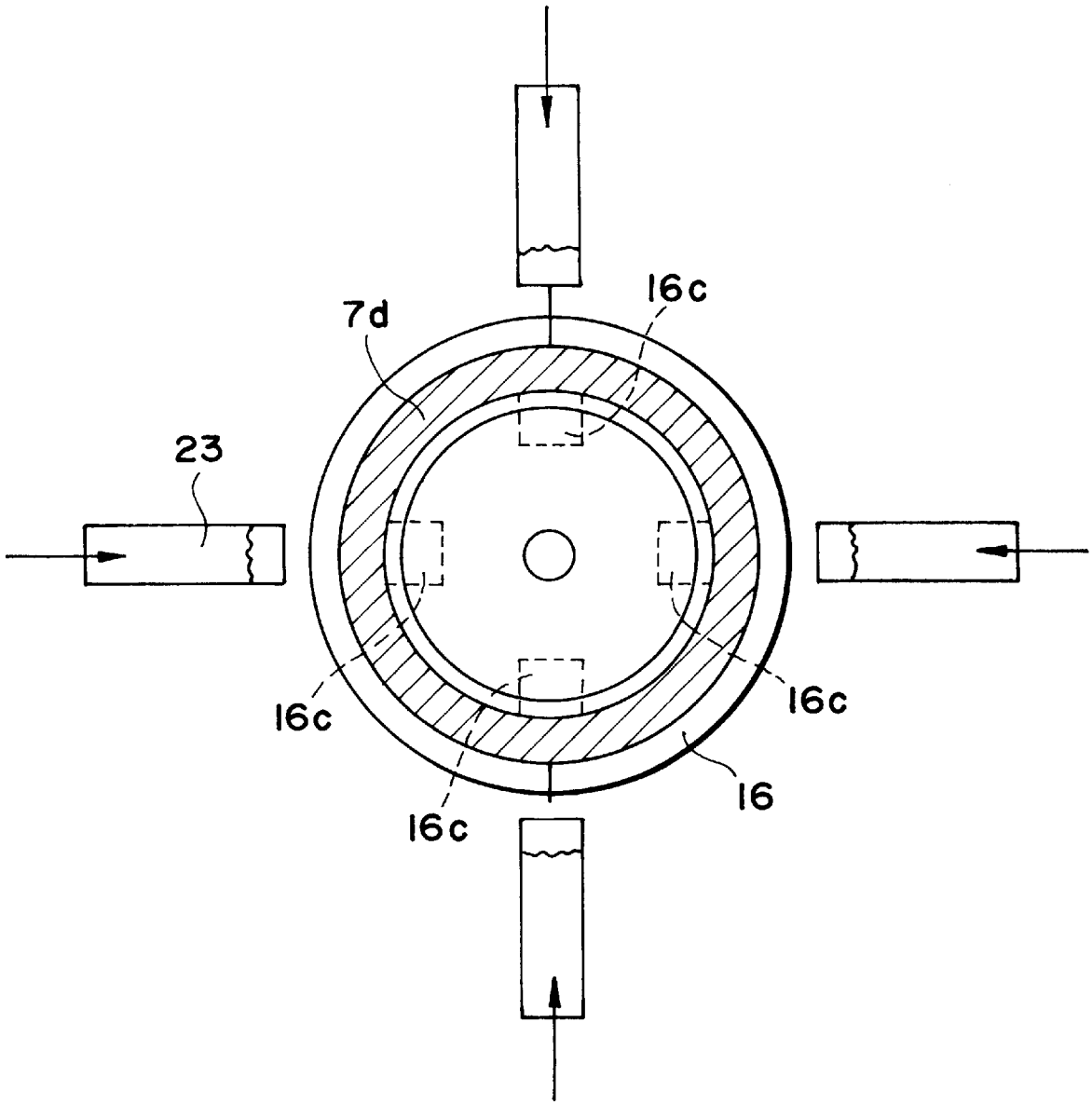
FIG. 3 is a plan view of the end of the cylinder in the cut and bend step.

FIG. 2 is a cross-sectional view to show the cut and bend step of the end of drum cylinder and FIG. 3 is a plan view thereof. The gear flange 16 is inserted into the end of the drum cylinder 7*d* of the photosensitive drum 7. Then, the parts of the stepped portion 7*g* are cut and bent toward the depressions 16*c* provided in the gear flange 16. The gear flange 16 is thus coupled with the end of drum cylinder 7*d*. A presser tool 23 for cutting and bending the stepped portion 7*g* will be described.

The presser tool 23 has working faces 23*a* for contact with the side face 16*e* and caulking flanks 16*d* of the gear flange 16. These working faces 23*a* work to transmit a reaction force of bending stress and shearing stress simultaneously occurring upon cut and bend of the parts of stepped portion 7*g* to the side face 16*e* and caulking flanks 16*d* of the gear flange 16. The side face 16*e* and caulking flanks 16*d* of the gear flange 16 desirably have wide areas, accordingly. If not, work flaws could be made in the gear flange 16 where the gear flange 16 is made of a plastic material. In the drawings, reference symbol 7*f* designates the cut and bent portions which are portions cut and bent by the working faces 23*a*. In the present embodiment the stepped portion 7*g* is not simply bent, but is cut and bent by the tool 23, thereby increasing the coupling force.

The tool edge is constructed in such a structure that bend acting portion 23*c* is provided at an angle $\alpha$ (approximately 30°) from tool tip 23*b* with respect to the working face 23*a*. A cross section of tool shank 23*d* is nearly a rectangle, having the same width as the circumferential width of the cross section of depression 16*c*. An angle of cutting edge is an angle between the bend acting portion 23*c* and the side face being continuous therefrom as crossing it. The angle of the cutting edge is 90° or a positive rake angle. A material for the presser tool 23 is tool steel.

Assembling steps of the cylindrical member will be described.

The gear flange 16 is fitted to the drum cylinder 7*d* along the outside diameter of the fitting portion 16*b* of gear flange 16. After this fitting, the end face 7*e* of drum cylinder 7*d* and the end face 16*e* of gear flange 16 are kept in press contact by a jig (not illustrated). At this time, the fitting between the gear flange 16 and the drum cylinder 7*d* is preferably fitting without play between them and without deformation of the outside diameter of drum cylinder 7*d*. More specifically, the clearance between the gear flange 16 and the drum cylinder 7*d* is preferably in the range of approximately 0 to 10 $\mu$m. After the gear flange 16 is fitted with the drum cylinder 7*d*, the aforementioned presser tool 23, having the tips of an acute angle, is moved toward the outer peripheral surface of drum cylinder 7*d* and comes to contact the outer peripheral surface of drum cylinder 7*d* at four positions in the circumferential direction of gear flange 16, as shown in FIG. 2 and FIG. 3.

At this time, the height of the working faces 23*a* of the presser tool 23 is the same as the position of the end face 7*e* of drum cylinder 7*d*. The width of the depressions 16*c* provided in the fitting portion 16*b* of gear flange 16 fitted in the drum cylinder 7*d* is equivalent to the width of the tip portions of the presser tool 23. As keeping the presser tool 23 and the depressions in the positional relation without deviation, the presser tool 23 is linearly moved in the radial direction of the gear flange 16 before it comes to contact the outer peripheral surface of drum cylinder 7*d*. Then the presser tool 23 is further moved into the gear flange 16 by a predetermined amount of penetration from the contact points, whereby the end portion (the stepped portion 7*g*) of the drum cylinder 7*d* is bent along the surface configuration of the bent acting portion 23*c* of the presser tool 23.

After that, the tool 23 is moved further to soon cut the end portion of drum cylinder 7*d* along the corners of depressions 16*c* in the fitting portion 16*b* of gear flange 16 to form parallel cut lines. Then the end portion (the stepped portion 7*g*) of drum cylinder 7*d*, partially cut and bent, is fixed in close fit with the caulking receiving faces 16*f* and the faces being continuous therefrom as crossing the caulking receiving faces 16*f* in the depressions 16*c*, thereby coupling the gear flange 16 with the drum cylinder 7*d*.

Namely, the advancing of the presser tool 23 completely cuts the stepped portion 7*g* at the end of the drum cylinder 7*d* to bring the cut faces into close fit with the configuration of depression 16*c*. Since the cut faces of the end partially cut and bent are coupled in close fit with the depressions 16*c* provided in the fitting portion 16*b* of the gear flange 16, a high coupling force can be maintained without a rattle, looseness, or the like in the rotational direction and in the axial direction of the photosensitive drum 7.

Figure 4:
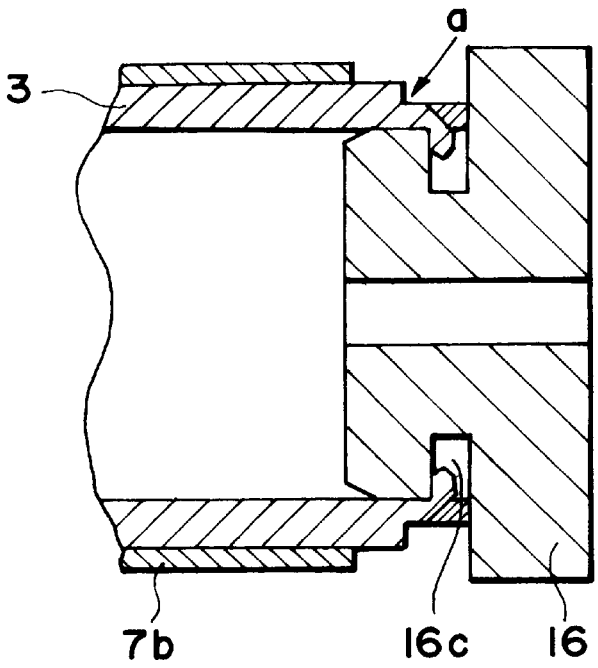
FIG. 4 is a longitudinal, cross-sectional view to show a step of step processing+cut and bend coupling.

The foregoing described the steps for coupling the cylinder with the engaging portion at the end thereof in the present embodiment. The function of the stepped portion formed at the end of cylinder, which is the feature of the embodiment, will be described referring to FIG. 4. FIG. 4 is a drawing to show the cut and bent coupling where the end of the cylinder according to the present embodiment is processed by the step forming process.

Comparing this coupling by a cut and bend process with bonding or the like, it has the merits that the coupling force can be kept at so high a strength as to be stable against thermal deformation and that coupling can be achieved instantaneously by a very simple method.

The present embodiment thus provides a highly accurate coupling method with a stable and firm coupling force and without causing deformation. FIG. 4 is a cross-sectional view to show an example of the photosensitive drum 7 according to the present embodiment described above. As shown in FIG. 4, the end portion of drum cylinder 7*d* has the stepped portion 7*g*. When the end portion of drum cylinder 7*d* is processed by the step forming process so as to make the end thinner than the original thickness, no deformation will take place around the cut and bent portions for the two reasons below.

(1) Thinning of the end of the drum cylinder can decrease resistance upon the cut and bend process.

(2) When the step is provided, stress that may cause deformation is concentrated at the corner a of the step. This can thus minimize propagation of deformation in the axial direction over the corner. In FIG. 4 the corner a of the step is illustrated at about 90°, but it may be of an acute angle or an obtuse angle within a range to induce the stress concentration.

Figure 5:
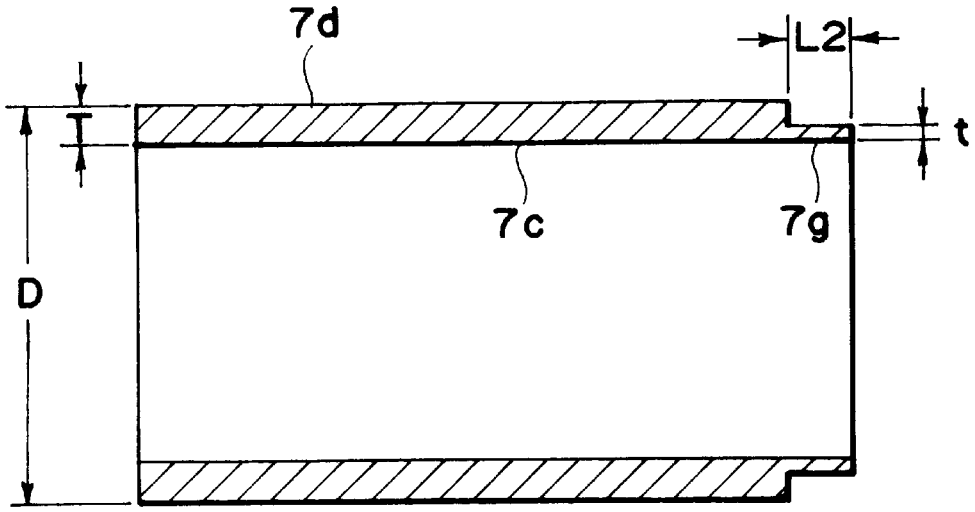
FIG. 5 is a longitudinal, cross-sectional view to show the dimensional relation of the cylinder according to the present invention.

FIG. 5 shows the dimensional relation of the step processed portion of the drum cylinder 7*d* alone.

FIG. 5 is a cross-sectional view to show an axial cross section of the drum cylinder 7*d* in the present embodiment. In the same drawing, T represents the thickness of the intermediate portion 7*c* of drum cylinder 7*d* and t represents the thickness of the stepped portion 7*g* at the end of drum cylinder processed by the step forming process. There is the following relation between T and t: T>t. Further, L2 represents the length of the step processed portion and D denotes the outside diameter of the cylinder. The results of our experiment showed that the greater the length L2 of the step processed portion, the less the deformation. However, lengths that are too large would affect the photosensitive layer 7*b* of the photosensitive drum 7 and small lengths are thus preferred as possible. The smaller the thickness t of the stepped portion 7*g*, the less the deformation. However, thicknesses that are too small would degrade torque loading performance of the coupling part, and the preferred thicknesses are thus approximately a quarter or more of the thickness T of the intermediate portion 7*c*.

Figure 6A:
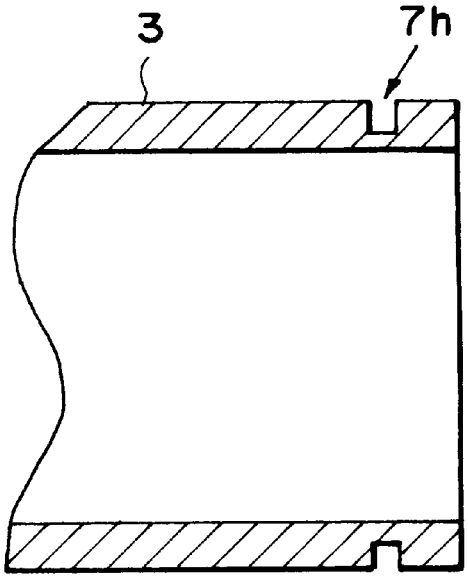
FIGS. 6A and 6B are longitudinal, cross-sectional views, each showing another embodiment.
Figure 6B:
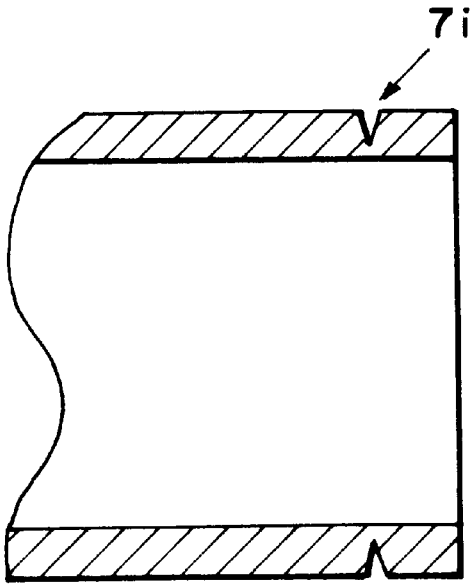

The shape of the stepped portion in the present embodiment is not limited to the above shape. For example, the stepped portion may be formed in such a shape that a plurality of grooves are formed partially in the circumferential direction like circumferential, rectangular groove 7*h* shown in FIG. 6A or like circumferential V-groove 7*i* shown in FIG. 6B. (Configurations of photosensitive drum)

Specific configurations of the photosensitive drum will be described in detail.

(1) An aluminum cylinder, which was made of an aluminum drawn pipe (name: H63S, the inside diameter of fitting portion: ϕ 62 mm, the thickness: 1.5 mm, the length: 365.5 mm) available from Kobe Steel, Ltd., was processed by the step forming process at the end thereof to form the stepped portion 7*g* in the length L2: 4 mm and the thickness t: 1.0 mm, obtaining the drum cylinder 7*d*.

This cylinder was coated with an ammonia solution of casein (casein 11.2 g, 28% ammonia water 1 g, water 222 ml) by the dip coating method and it was dried to form an under coating layer in a coating amount of 1.0 g/m.

Then a part by weight of aluminum chloride phthalocyanine, a part by weight of butyral resin (trade name: ESLEC BM-2: available from Sekisui Chemical Co., Ltd.), and 30 parts by weight of isopropyl alcohol were dispersed for four hours by a ball mill dispersion mixer. This dispersion solution was applied onto the under coating layer formed in the above step by the dip coating method and was dried to form a charge generating layer. The thickness at this time was 0.3 μm.

Then a part by weight of hydrazone compound, a part by weight of polysulfone resin (trade name: P1700: available from Union Carbide), and 6 parts by weight of monochlorobenzene were mixed and stirred to dissolve by a stirrer. This solution was applied onto the charge generating layer by the dip coating method and was dried to form a charge transport layer. The thickness at this time was 12 μm. The distance L3 of the end face 7*h* of the photosensitive layer 7*b* thus formed from the end face 7*e* of the drum cylinder 7*d* was 12 mm.

The drum gear flange 16 was made by injection molding of polyacetal resin (trade name: "Juracon M90-02" a copolymer available from Polyplastic) (with the outside diameter of the fitting portion: ϕ58.6 mm, under the following molding conditions: the nozzle temperature: 200° C., the cylinder temperature: 180° C. at the tip, the intermediate portion 170° C., the rear part 160° C., the injection pressure: 800 kg/cm, the mold temperatures: 60° C. in the cavity and 60° C. in the core). The depressions 16*c* of the rectangular hole shape (the width 3 mm, the height 1 mm, and the depth 3 mm) were made at four positions in the directions of right angles from the center of gear flange 16 in the fitting portion 16*b* of the gear flange 16. The drum gear flange 16 was fitted to the drum cylinder 7*d* (circular barrel) thus fabricated. The presser tool 23 composed of the material SKD 30 having a width of 3 mm at the tip and an angle of 30° was urged against the depressions 16*c* by the penetration amount of 1.5 mm. In this way, the end of the drum cylinder 7*d* was cut and bent along the configuration of the depressions 16*c*, thereby fabricating the photosensitive drum 7 in which the gear flange 16 and drum cylinder 7*d* were coupled with each other.

For checking deformation around the flange-coupling portion of the photosensitive drum 7 obtained in this way, cylindricity was measured at intervals of 1 mm at the position of about 50 mm from the drum cylinder end face 7*e* by use of a roundness measuring device (RA-600 available from Mitsutoyo). As a result, the cylindricity was 11 μm.

The photosensitive drum 7 thus obtained was mounted on a process cartridge B of a laser beam printer A available from CANON INC. Then, this process cartridge B was kept still for 48 hours in a high-temperature and high-humidity vessel (specifically, at a temperature of 32.5° C. and a relative humidity of 85 %). After that, the process cartridge B was set in the main body 13 of laser beam printer under the same circumstances and intermittent formation of 10000 images was carried out. After image formation, the photosensitive drum 7 was taken out of the process cartridge B and it was checked whether there was rattle, looseness, or disconnection due to the durability test in the connecting parts of the gear flange 16 and drum cylinder 7*d*. The result of the check showed that these effects were present not at all, and thus good images were obtained without the problems of pitch nonuniformity, fog, and the like on the images by the drum cylinder 7*d*. The photosensitive drum 7 after the durability test was kept fixed and torque was applied to the gear flange 16 by use of a commercially available torque gauge to measure the breakdown torque of the coupling parts of the drum cylinder 7*d* and gear flange 16. As a result, the measured breakdown torque was 154 kg-cm.

(2) The photosensitive drum 7 was fabricated under the same conditions as in Example (1) except that the thickness t of the stepped portion 7*g* in Example (1) was changed to 0.8 mm. The same measurement and evaluation as in Example (1) were carried out. The evaluation result was the same as that in Example (1). The breakdown torque of the coupling parts of the drum cylinder 7*d* and gear flange 16 at that time was 122 kg-cm and the cylindricity of the end of the drum cylinder 7*d* was 8 μm.

(3) The photosensitive drum 7 was fabricated under the same conditions as in Example (1) except that the thickness t of the stepped portion 7*g* in Example (1) was changed to 0.6 mm. The same measurement and evaluation as in Example (1) were carried out. The evaluation result was the same as that in Example (1). The breakdown torque of the coupling parts of the drum cylinder 7*d* and gear flange 16 was 110 kg-cm and the cylindricity of the end of drum cylinder 7*d* was 6 μm.

(4) The photosensitive drum 7 was fabricated under the same conditions as in Example (1) except that the thickness t of the stepped portion 7*g* in Example (1) was changed to 0.5 mm. The same measurement and evaluation as in Example (1) were carried out. The evaluation result was the same as that in Example (1). The breakdown torque of the coupling parts of the drum cylinder 7*d* and gear flange 16 was 103 kg-cm and the cylindricity of the end of drum cylinder 7*d* was 5 μm.

For checking the deformation around the flange-coupling portion of the photosensitive drum 7 thus obtained, the roundness and cylindricity were measured at intervals of 1 mm at the position of about 50 mm from the end portion of drum cylinder 7*d* by use of the roundness measuring device (RA-600 available from Mitsutoyo). As a result, the cylindricity was 46 μm, which was inferior to those of the foregoing examples.

The results of the above examples are shown together in Table 1.

TABLE 1

| | Coupling method | Thickness of stepped portion: t | Coupling torque | Cylindricity | Evaluation of image |
|---|---|---|---|---|---|
| Ex 1 | step forming process + cut and bend | 1 | 154 kg-cm | 11 μm | ◎ |

TABLE 1-continued

| | Coupling method | Thickness of stepped portion: t | Coupling torque | Cylindricity | Evaluation of image |
|---|---|---|---|---|---|
| Ex 2 | step forming process + cut and bend | 0.8 | 122 kg-cm | 8 μm | ◎ |
| Ex 3 | step forming process + cut and bend | 0.6 | 110 kg-cm | 6 μm | ◎ |
| Ex 4 | step forming process + cut and bend | 0.5 | 103 kg-cm | 5 μm | ◎ |

Figure 20:
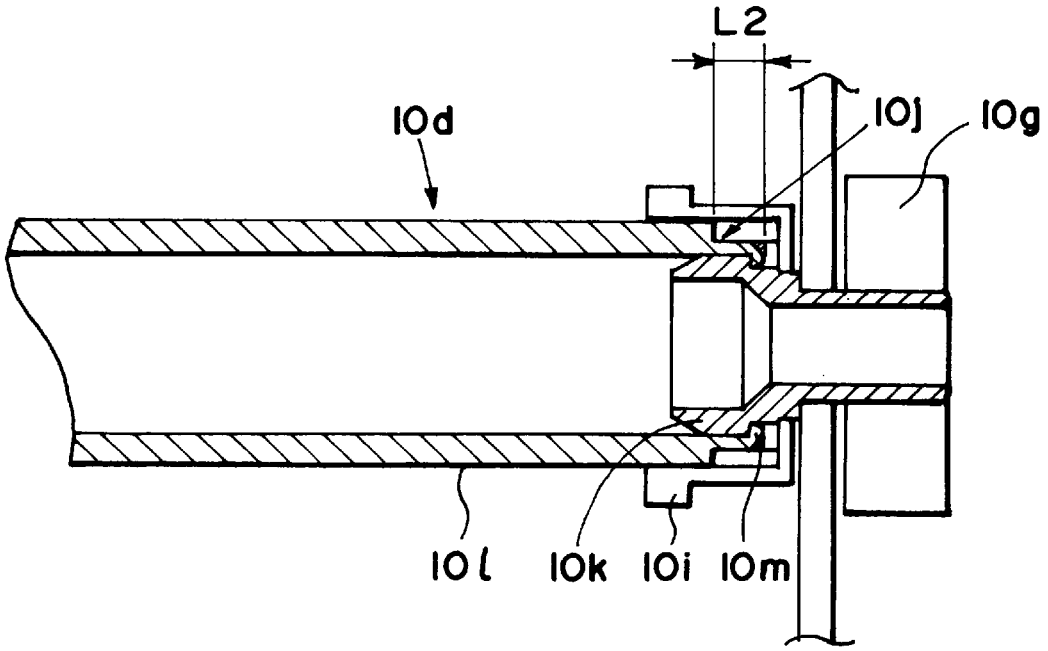
FIG. 20 is a longitudinal, cross-sectional view of a developing roller according to an embodiment of the present invention.

Description of symbols
◎: very good
○: good
Δ: no problem in practical use
x: will pose a problem in practical use As apparent from Table 1, the thickness of the thin portion (the stepped portion) is preferably between 0.5 mm and 1.0 mm. The thickness of the thin portion is more preferably between 0.6 mm and 0.8 mm. (Configurations of developing roller) Specific configurations of the developing roller will be described. FIG. 20 is a longitudinal, cross-sectional view of a developing roller according to the present embodiment.

<Example 4>

An aluminum cylinder, which was an aluminum drawn cylinder 101 (the outside diameter: ϕ16 mm, the thickness: 2 mm, the length: 330 mm) available from Kobe Steel, Ltd., was subjected to the step forming process at the end thereof to form the stepped portion 10*j* in the length L2: 3 mm and the thickness t of the stepped portion 10*j*: 0.8 mm.

Then a paint was prepared by mixing 20 parts by weight of phenol resin, 9 parts by weight of natural graphite (average particle diameter 7 μm), a part by weight of carbon black (average particle diameter 0.2 μm), and 20 parts by weight of IPA, dispersing them for three hours with a mixture of glass beads in a paint shaker, and controlling the solid content of the paint to 25%. After that, the paint was applied to the surface of the cylinder by the air spray method to form a coating layer and it was then heated at 150° C. for 30 minutes in a hot-air drying furnace to harden.

The cylinder 101 fabricated in this way was coupled with sleeve flange 10*k* made by injection molding of polyacetal resin (trade name: "Juracon AW-01" available from Polyplastic) in such a way that the sleeve flange 10*k* was lightly pressed into a spigot joint portion of the cylinder 101 before the flange 10*k* was fitted in the cylinder 101. An amount of press fitting between the flange 10*k* and the cylinder 101 at this time was 10 μm.

The depressions of the rectangular hole shape (the width: 3 mm, the height: 1 mm, the depth: 3 mm) were formed at four positions in the directions of right angles from the center of flange in the coupling part of the flange and then the presser member of the material SKD 30, having a width 3 mm and an angle 30° at the tip, was moved into the depressions by the penetration amount of 1.5 mm. Then a cut and bend (the cut and bent portion 10 m) was made while the end of cylinder was bent along the configuration of depressions, thus fabricating the developing roller in which the flange and cylinder were coupled with each other.

For checking the deformation around the flange-coupling part of the developing roller obtained in this way, the cylindricity was measured at intervals of 1 mm at the position of about 50 mm from the end face of cylinder by use of the roundness measuring device (RA-600 available from Mitsutoyo). As a result, the cylindricity was 11 μm.

The developing roller thus obtained was mounted on a process cartridge of the laser beam printer available from CANON INC. Then this process cartridge was kept still for 48 hours in the high-temperature and high-humidity vessel (specifically, at the temperature 32.5° C. and the relative humidity 85%). After that, the process cartridge was set in the laser beam printer under the same circumstances and intermittent formation of 10000 images was carried out. After the image formation, the developing roller was taken out of the process cartridge and was checked as to whether rattle, looseness, or disconnection occurred in the coupling parts of the flange and cylinder. The result showed that such at all, and thus good images were obtained without the problems of pitch nonuniformity depending upon cycles of sleeve, fog, and the like on the images. After the durability test, the developing roller was kept fixed and the breakdown torque was measured at the coupling part of the flange by a commercially available torque gauge.

As a result, the breakdown torque was 97 kg·cm.

<Example 5>

The developing roller was fabricated and evaluated by the same methods as in Example 4 except that the thickness t of the step processed portion was changed to 0.6 mm. The result showed that very good images were obtained without the problems, especially without the pitch nonuniformity depending upon cycles of the sleeve, as in Example 4. The cylindricity at this time was 9 μm and the breakdown torque was 90 kg·cm.

<Example 6>

The developing roller was fabricated and evaluated by the same methods as in Example 4 except that the thickness: t of the step processed portion was changed to 0.4 mm. The result showed that very good images were obtained without the problems, especially without the pitch nonuniformity depending upon cycles of sleeve, as in Example 4. The cylindricity at this time was 7 μm and the breakdown torque was 82 kg·cm.

The results of the above examples are shown together in Table 2.

TABLE 2

| | Coupling method | Thickness of stepped portion: t | Coupling torque | Cylindricity | Evaluation of image |
|---|---|---|---|---|---|
| Ex 4 | step forming process + cut and bend | 0.8 mm | 97 kg-cm | 11 μm | ◎ |
| Ex 5 | step forming process + cut and bend | 0.6 mm | 90 kg-cm | 9 μm | ◎ |
| Ex 6 | step forming process + cut and bend | 0.4 mm | 82 kg-cm | 7 μm | ◎ |

Description of symbols
◎: very good
○: good
Δ: no problem in practical use
x: will pose a problem in practical use As apparent from Table 2, the thickness of the thin portion (the stepped portion) is preferably between 0.4 mm and 0.8 mm.

The cylindrical member according to the present invention is not limited to the photosensitive drum and the developing roller, but it can be effectively applied to any member that is required to have strong coupling between the cylinder and the engaging member at the end. It is also effectively applied to various roller members to which a driving force is transmitted, for example, such as a platen roller, a conveying roller, a fixing roller, or a printing plate roll.

As described above, the present invention can provide a highly accurate cylindrical member, because the engaging member is attached to the cylinder by bending the thin portion of the cylinder toward the depressions.

(Description of electrophotographic image forming apparatus and process cartridge)

The electrophotographic image forming apparatus and process cartridge as an embodiment will be described in detail with reference to the drawings.

In the process cartridge described below, the embodiment described above is applied to at least either one of the electrophotographic photosensitive drum 7 and the developing roller 10*d*. In the embodiment described below, the drum flange 16 receives the driving force for rotating the electrophotographic photosensitive drum 7 through projection 17*a* from the main body of the apparatus. Then, the rotating force is transmitted through helical gear 16*a* to the developing roller 10*d*.

In the following description, the lateral direction of the process cartridge B is a direction in which the process cartridge B is mounted or dismounted with respect to the main body 13, which is coincident with the conveying direction of the recording medium. The longitudinal direction of the process cartridge B is a direction crossing (nearly perpendicular to) the direction in which the process cartridge B is mounted or dismounted with respect to the main body 13. This direction is parallel to the surface of recording medium and crosses (nearly perpendicular to) the conveying direction of the recording medium. Right or left with respect to the process cartridge is defined when the recording medium is viewed from the top along the conveying direction of recording medium.

Figure 7:
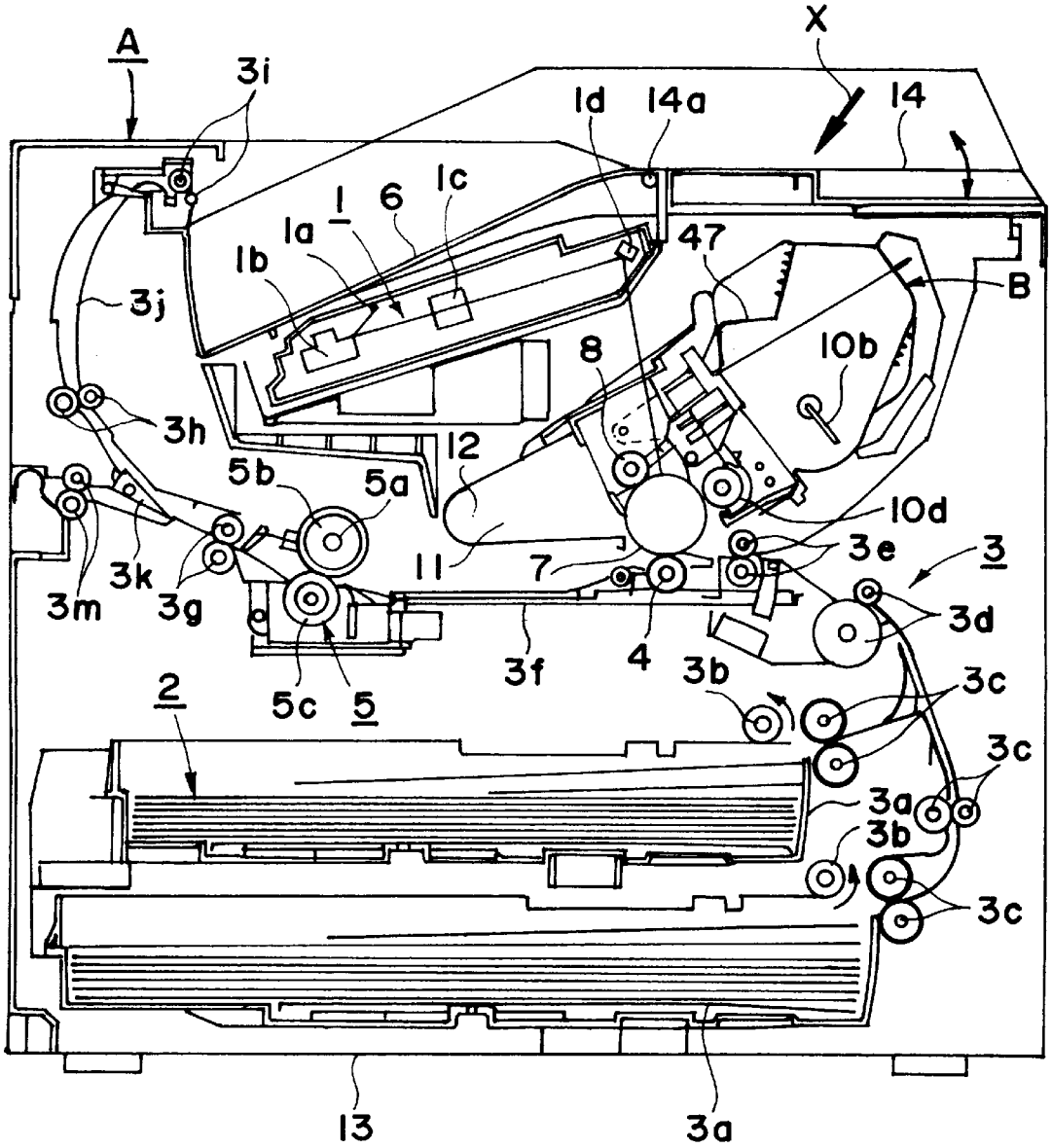
FIG. 7 is a longitudinal, cross-sectional view to show the schematic structure of a normal transfer type electrophotographic apparatus incorporating the photosensitive drum according to the embodiment.
Figure 8:
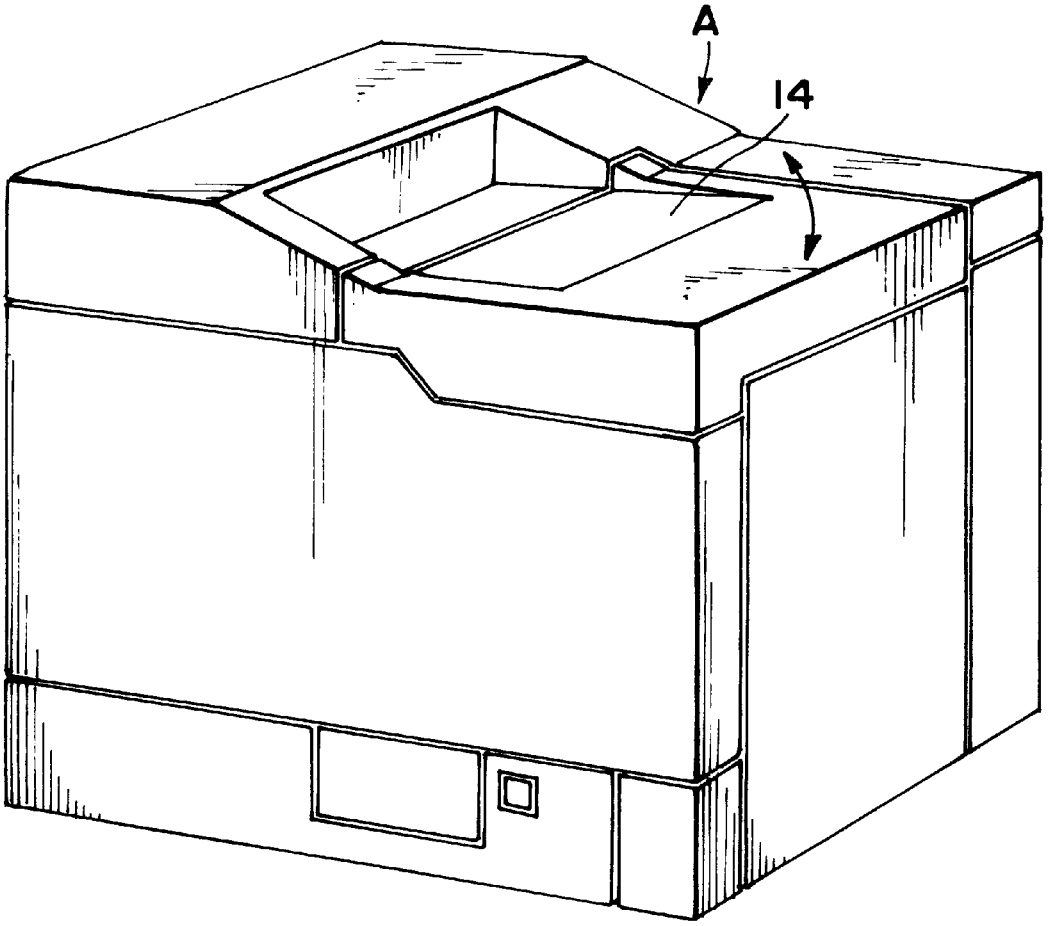
FIG. 8 is a perspective view to show the appearance of the apparatus shown in FIG. 7.

FIG. 7 is an explanatory drawing to show the configuration of the electrophotographic image forming apparatus (laser beam printer) as an embodiment. FIG. 8 is a perspective view to show the appearance of the apparatus. FIG. 9 to FIG. 14 are drawings to show the process cartridge to which the embodiment of the present invention is applied. In the following description, the top surface of the process cartridge B is a surface located up when the process cartridge is mounted in the main body 13, and the bottom surface is a surface located down.

(Electrophotographic image forming apparatus A and process cartridge B)

Figure 9:
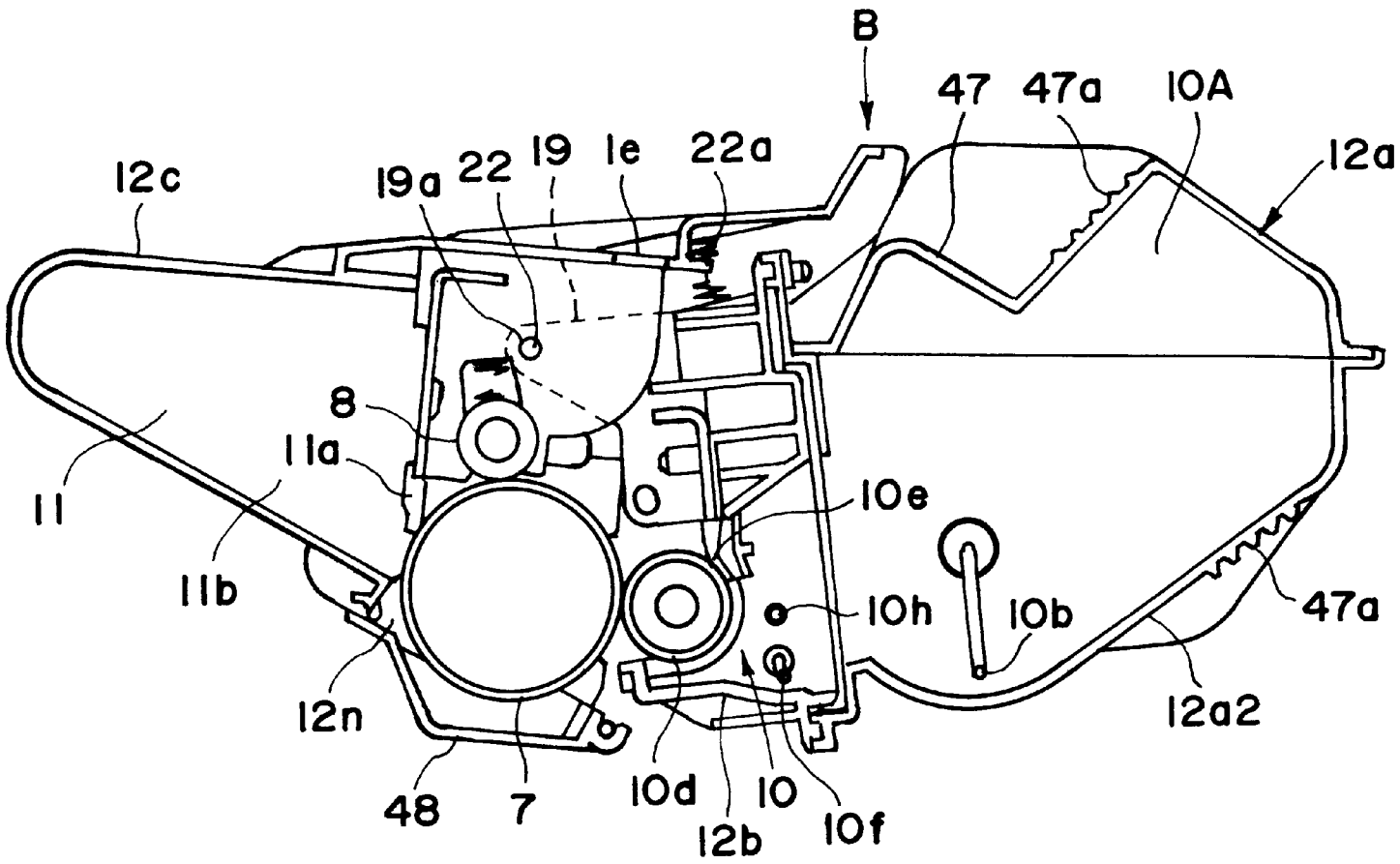
FIG. 9 is a longitudinal, cross-sectional view of a process cartridge.

First, the laser beam printer A as an electrophotographic image forming apparatus to which the embodiment of the present invention is applied will be described with reference to FIG. 7 and FIG. 8. FIG. 9 shows a cross-sectional side view of the process cartridge B.

This laser beam printer A is for forming an image on a recording medium (for example, recording sheet, OHP sheet, fabric, etc.) by the electrophotographic image forming process. A toner image is formed on an electrophotographic, photosensitive member of a drum shape (as will be referred to as "a photosensitive drum"). Specifically, the photosensitive drum is electrified by a charging device. Then the photosensitive drum is exposed to laser light according to image information from an optical device, whereby a latent image according to the image information is formed on the photosensitive drum. Then, this latent image is developed by a developing device to form a toner image. In synchronization with the formation of the toner image, the recording medium 2 set in sheet feed cassette 3*a* is conveyed, as inverted, through pickup roller 3*b*, conveying roller pair 3*c*, 3*d*, and registration roller pair 3*e*. Then, the toner image formed on the photosensitive drum 7 of the process cartridge B is transferred to the recording medium 2 by applying voltage to transfer roller 4 as a transferring device.

After that, the recording medium 2 to which the toner image was transferred is conveyed through conveying guide 3*f* to fixing device 5. This fixing device 5 has driving roller 5*c* and fixing roller 5*b* incorporating heater 5*a*. The toner image thus transferred is fixed by applying heat and pressure to the passing recording medium 2. Then this recording medium 2 is conveyed through discharge rollers 3*g*, 3*h*, 3*i* to be discharged through inversion path 3*j* onto discharge tray 6. This discharge tray 6 is provided on the top surface of the main body 13 of the image forming apparatus A. The recording medium 2 may also be discharged without passing the inversion path 3*j* by actuating a rockable flapper 3*k* to guide it through discharge roller pair 3*m*.

In the present embodiment the conveying device 3 is composed of the pickup roller 3*b*, conveying roller pair 3*c*, 3*d*, registration roller pair 3*e*, conveying guide 3*f*, discharge roller group 3*g*, 3*h*, 3*i*, and discharge roller pair 3*m*.

On the other hand, the process cartridge B rotates the photosensitive drum 7 having the photosensitive layer 7*b* (see FIG. 1 and FIG. 17) to uniformly charge the surface thereof by applying the voltage to the charging roller 8 as a charging device, as shown in FIG. 1 and FIG. 9 to FIG. 14. Then the photosensitive drum 7 is exposed to the laser beam light according to the image information from the optical system 1 through an exposure aperture 1*e*, thereby forming a latent image thereon. Then, this latent image is developed by the developing device 10 with toner. Namely, the charging roller 8 is in contact with the photosensitive drum 7 and electrifies the photosensitive drum 7. This charging roller 8 is rotated as following the photosensitive drum 7. The developing device 10 supplies the toner to the development area of the photosensitive drum 7 to develop the latent image formed on the photosensitive drum 7. The optical system 1 has laser diode 1*a*, polygon mirror 1*b*, lens 1*c*, and reflecting mirror 1*d*.

Here, the developing device 10 feeds the toner in the toner container 10A to the developing roller 10*d* by rotation of toner feed member 10*b*. Then, the developing roller 10*d*, having a built-in stationary magnet, is rotated and a toner layer with triboelectrification charge is formed on the surface of developing roller 10*d* by developing blade 10*e*. The toner is supplied to the development area of photosensitive drum 7. Then, the toner is transferred to the photosensitive drum 7, depending upon the latent image, to visualize the latent image as forming a toner image. The developing blade 10*e* is for determining a toner amount on the peripheral surface of developing roller 10*d* and for giving the toner the triboelectrification charge. A toner agitating member 10*f* for circulating the toner in the developing chamber is mounted as rotatable in the vicinity of the developing roller 10*d*.

Then the voltage of the opposite polarity to that of the foregoing toner image is applied to the transferring roller 4 to transfer the toner image formed on the photosensitive drum onto the recording medium 2. After that, the residual toner on the photosensitive drum 7 is removed by a cleaning device 11. This cleaning device 11 scrapes off the toner remaining on the photosensitive drum 7 by an elastic cleaning blade 11*a* provided in contact with the photosensitive drum 7 to store the scraped-off toner in waste toner reservoir 11*b*.

The process cartridge B is constructed by coupling the toner frame 12*a* having the toner container (toner storing section) 1OA for storing the toner with developing frame 12*b* for holding the developing device 10 including the developing roller 10*d*, etc. Then it is coupled with cleaning frame 12*c* incorporating the photosensitive drum 7, the cleaning device 11 including the cleaning blade 11*a*, etc., and the charging roller 8. This process cartridge B can be mounted or dismounted with respect to the image forming main body 13 by an operator.

This process cartridge B is provided with the exposure aperture 1*e* for exposing the photosensitive drum 7 to the light according to the image information and a transfer aperture 12*n* for opposing the photosensitive drum 7 to the recording medium 2. Specifically, the exposure aperture 1*e* is formed in the cleaning frame 12*c*. The transfer aperture 12*n* is provided between the developing frame 12*b* and the cleaning frame 12*c*.

Next described is the configuration of the housing of the process cartridge B according to the present embodiment.

For constructing the process cartridge B shown in the present embodiment, the toner frame 12*a* is first coupled with the developing frame 12*b*. Then the cleaning frame 12*c* is coupled as rotatable with it to form the housing, and the photosensitive drum 7, charging roller 8, developing device 10, and cleaning device 11 are stored in the housing, thus forming a cartridge. Then, this process cartridge B is removably mounted on a cartridge mounting device provided in the image forming main body 13.

(Configuration of housing of process cartridge B)

The process cartridge B according to the present embodiment is constructed by coupling the toner frame 12*a*, the developing frame 12*b*, and the cleaning frame 12*c* with each other to form the housing as described above. The configuration will be detailed below.

As shown in FIG. 9, the toner feed member 10*b* is attached as rotatable to the toner frame 12*a*. The developing roller 10*d* and developing blade 10*e* are mounted in the developing frame 12*b*. Further, the toner agitating member 10*f* for circulating the toner in the developing chamber is mounted as rotatable in the vicinity of the developing roller 10*d*. In the developing frame 12*b* an antenna rod 10*h* is mounted nearly parallel to the developing roller 10*d* and opposite to the longitudinal direction thereof, as shown in FIG. 9. Then, the toner frame 12*a* and developing frame 12*b* are welded with each other (by ultrasonic welding in the present embodiment) to form a developing unit D (see FIG. 19) as an incorporated second frame.

The toner developing unit is provided with drum shutter member 48 for covering the photosensitive drum 7 when the process cartridge B is removed from the image forming main body 13, thereby protecting the photosensitive drum 7 from exposure to light for a long period or from contact with foreign matter or the like.

Figure 18:
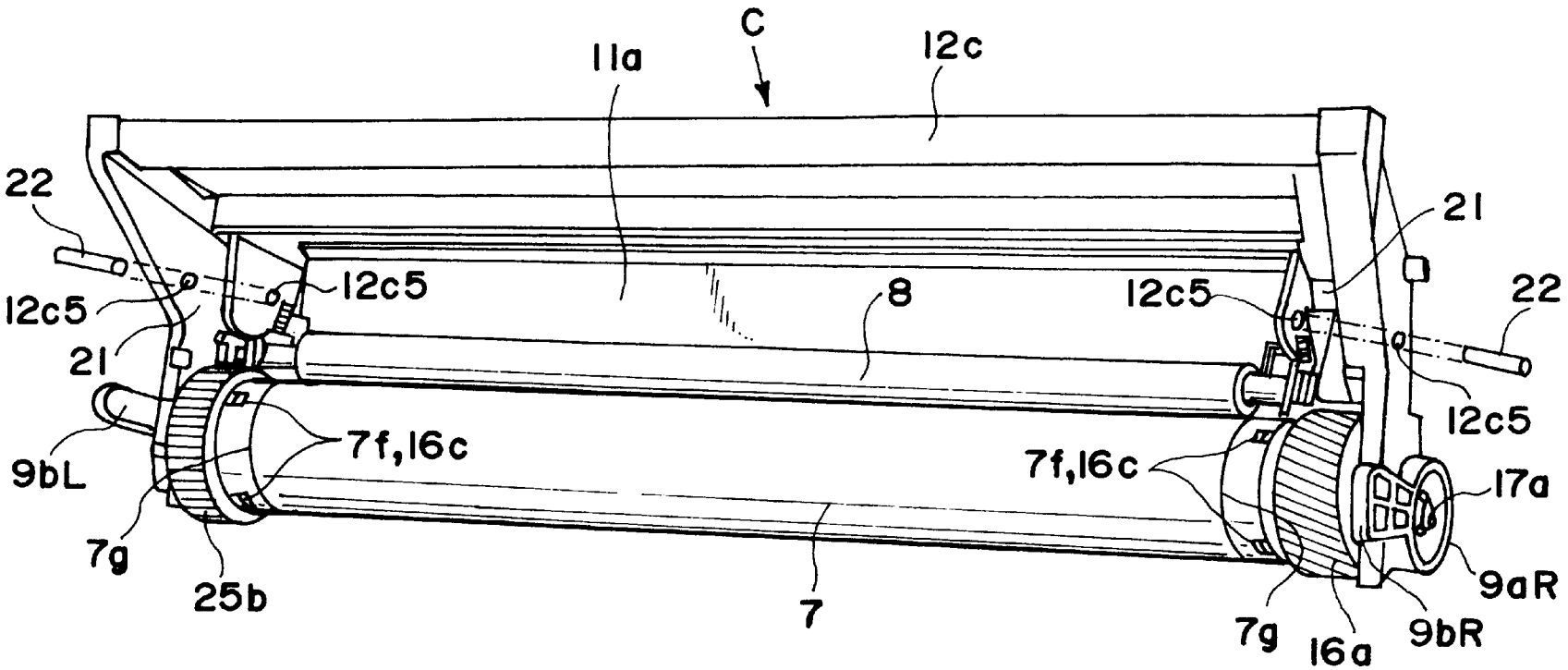
FIG. 18 is a perspective view of a cleaning unit.

As shown in FIG. 9 and FIG. 18, the cleaning frame 12*c* is provided with the members including the photosensitive drum 7, charging roller 8, and cleaning device 11, thereby composing a cleaning unit C (see FIG. 18) as a first frame.

Figure 19:
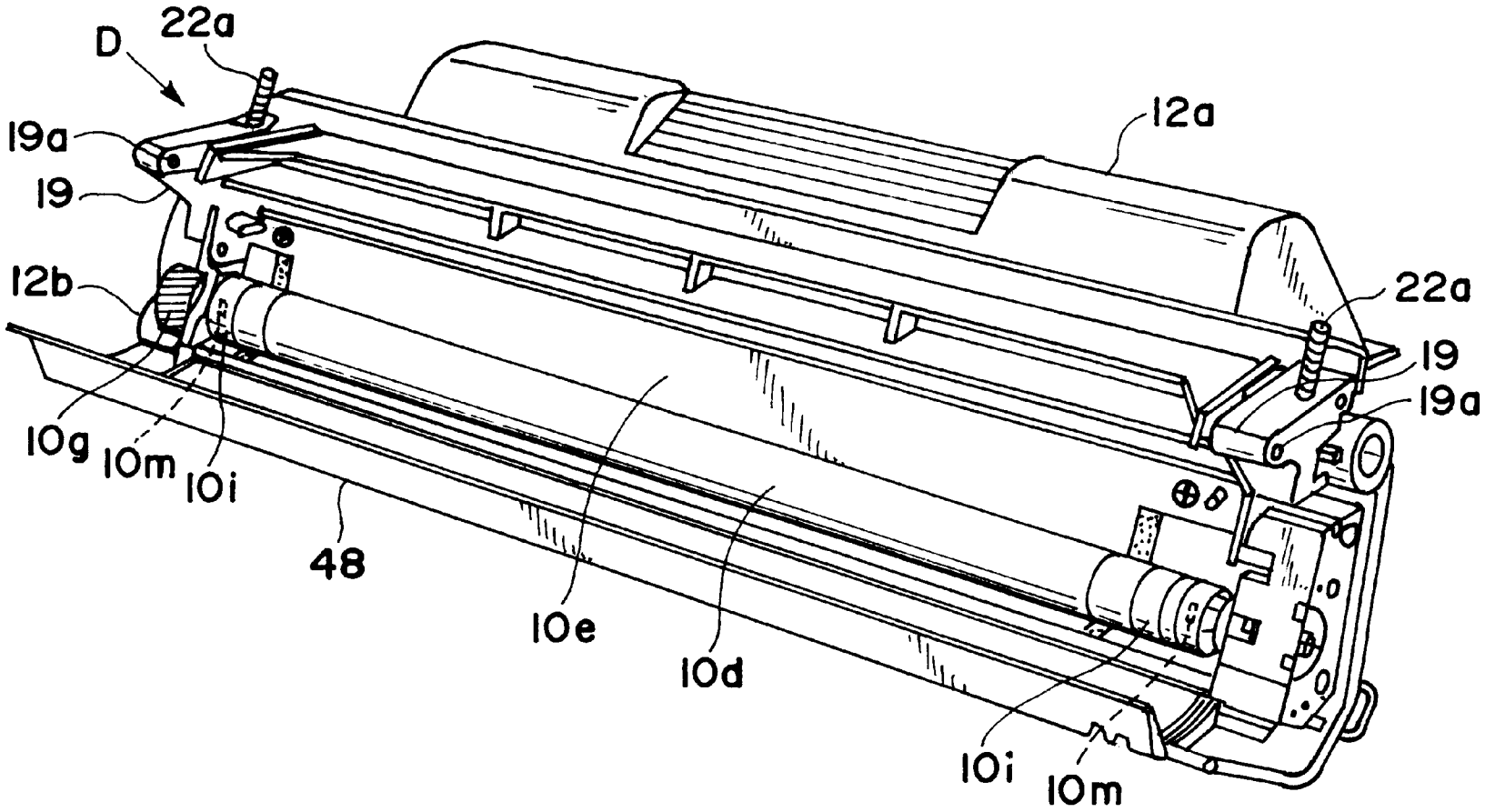
FIG. 19 is a perspective view of a developing unit.

Then, the above developing unit D and cleaning unit C are coupled as rotatable with each other by coupling members 22 of circular pins, thereby composing the process cartridge B. Namely, as shown in FIG. 19, a rotation hole 19*a* of a circular shape is provided in parallel to the developing roller 10*d* at the distal end of each arm 19 formed on either side of the longitudinal direction (the direction along the axis of the developing roller 10*d*) of the developing frame 12*b* (see FIG. 19). On the other hand, recesses 21 for the arms 19 to enter are provided at two positions on the both sides of the longitudinal direction of the cleaning frame 12*c* (see FIG. 18). The arms 19 are inserted into the recesses 21, and the coupling members 22 are pressed into associated mounting holes 12*c*5 of the cleaning frame 12*c*, are fitted into the rotation holes 19*a* at the ends of the arms 19, and further are pressed into inside holes 12*c*5. This causes the developing unit D and cleaning unit C to be coupled with each other as rotatable about the coupling members 22.

At this time a compression coil spring 22*a* seated on an unrepresented dowel standing at the root of each arm 19 comes to contact the upper wall of the recess 21 in the cleaning frame 12*c*. These compression coil springs 22*a* urge the developing frame 12*b* downward, thereby securely pushing the developing roller 10*d* against the photosensitive drum 7. The upper wall of each recess 21 of the cleaning frame 12*c* is provided with such an inclination that the above compression coil springs 22*a* may gradually increase compression from a non-compressing state upon assembly of the developing unit D and cleaning unit C. Spacer rollers 10*i* having a larger diameter than the developing roller 10*d* are attached at the both longitudinal ends of the developing roller 10*d* as shown in FIG. 19.

This arrangement causes the rollers 10*i* to be urged against the photosensitive drum 7, so that the photosensitive drum 7 and the developing roller 10*d* may be opposed to each other with a constant gap (approximately 300 μm). Accordingly, the developing unit D and cleaning unit C are rotatable relative to each other about the coupling members 22 and the positional relation between the peripheral surface of photosensitive drum 7 and the peripheral surface of developing roller 10*d* can be maintained by the elastic force of the compression coil springs 22*a*. (Configuration of guide means for process cartridge B)

Figure 15:
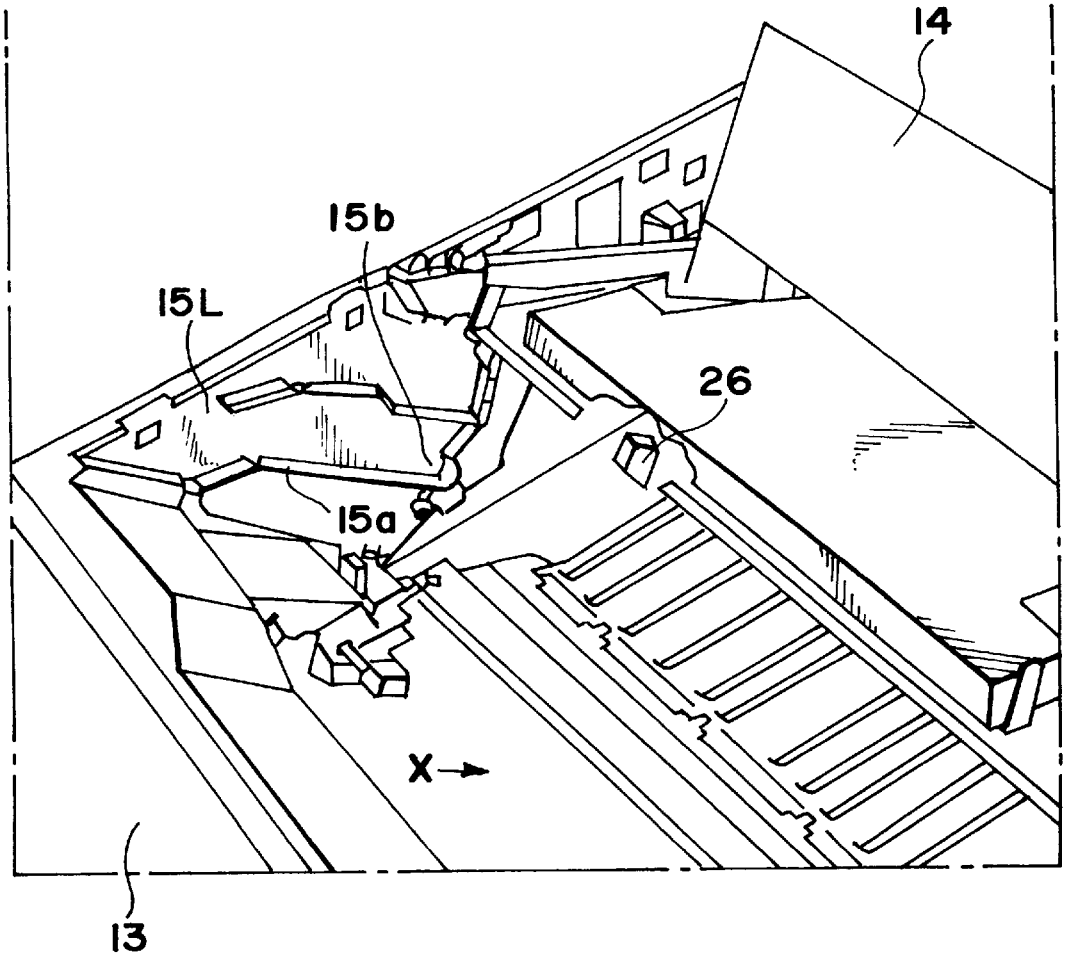
FIG. 15 is a perspective view of appearance to show a mounting portion for the process cartridge in the main body of the apparatus.
Figure 16:
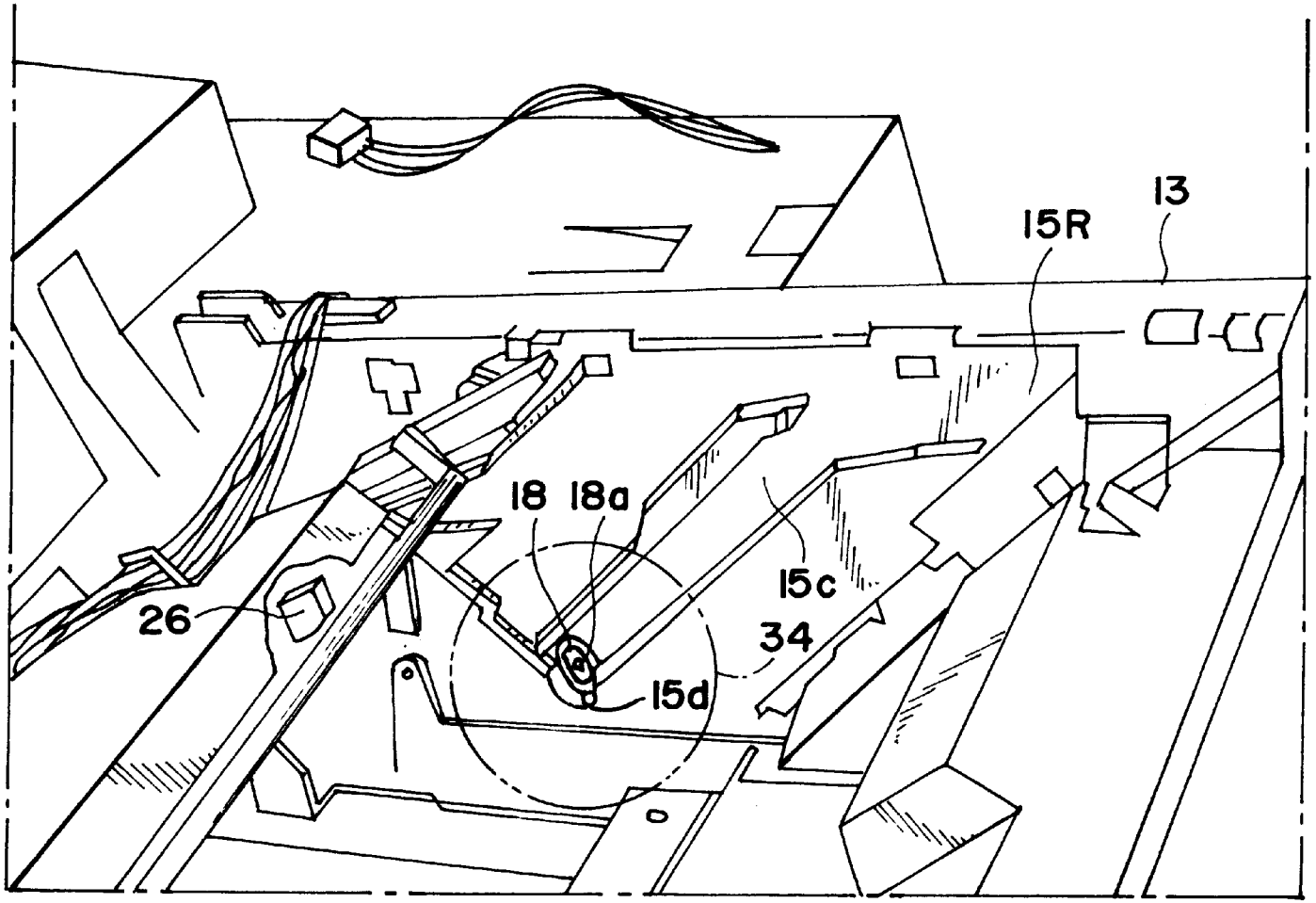
FIG. 16 is a perspective view of appearance to show another mounting portion for the process cartridge in the main body of the apparatus.

Next described is a guide means used upon mounting or dismounting of the process cartridge B with respect to the main body 13. This guide means is shown in FIG. 15 and FIG. 16. FIG. 15 is a perspective view of the left side of the apparatus when viewed along the direction of mounting of the process cartridge B into the main body 13 (i.e., along the arrow X) (i.e., when the apparatus is observed from the developing unit D side). FIG. 16 is a perspective view of the right side.

A guide device for guiding the process cartridge B upon mounting or dismounting thereof into the main body 13 is provided on either side face of the cleaning frame 12*c*, as shown in FIG. 10, FIG. 11, FIG. 12, and FIG. 13. Each guide device is composed of a cylindrical guide 9*a*R, 9*a*L as a positioning guide member and a locking guide 9*b*R, 9*b*L as a guide member being a posture holding means upon mounting or dismounting.

As shown in FIG. 18, the cylindrical guide 9*a*R is a hollow, cylindrical member. The locking guide 9*b*R is formed as integral with the cylindrical guide 9*a*R and projects almost in a radial direction integrally from the circumference of the cylindrical guide 9*a*R. The cylindrical guide 9*a*R is provided with mounting flange 9*a*Rl integral therewith. The right guide member 9R, having the cylindrical guide 9*a*R, locking guide 9*b*R, and mounting flange 9*a*Rl as described, is screwed to the cleaning frame 12*c* with small screws 9*a*R2 inserted in associated holes for small screw of the mounting flange 9*a*Rl. The locking guide 9*b*R of the right guide member 9R fixed to the cleaning frame 12*c* is located on the side face side of the developing frame 12*b* so as to extend to the side of development holder 41 fixed to the developing frame 12*b*.

Figure 17:
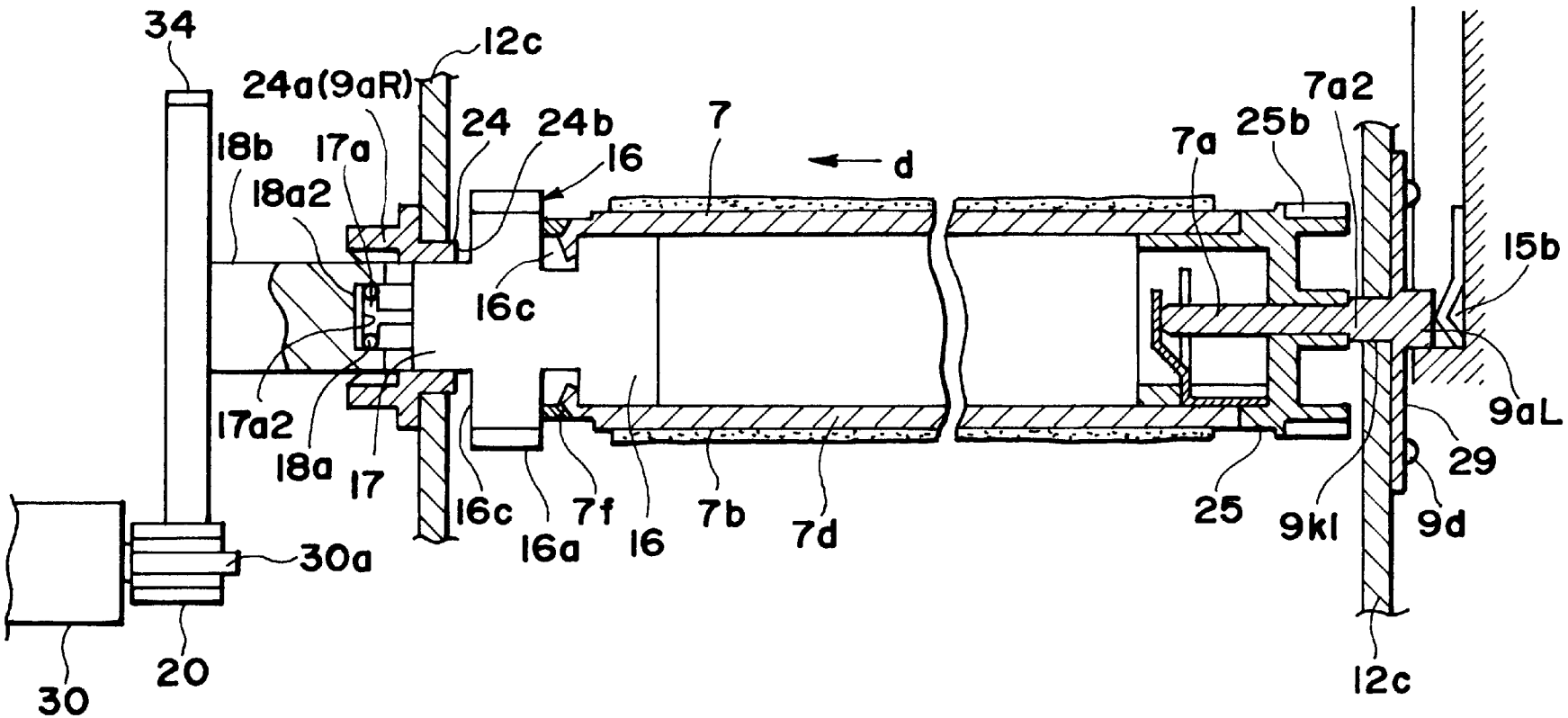
FIG. 17 is a longitudinal, cross-sectional view of a photosensitive drum and a driving device thereof.

As shown in FIG. 17, an enlarged diameter portion 7*a*2 of the drum shaft 7*a* is fitted in a hole 9*k*l (see FIG. 17) of the cleaning frame 12*c*. The cylindrical guide 9*a*L projects outwardly (in the perpendicularly outgoing direction from the plane of FIG. 12) from a flat plate flange 29 fitted for stop of rotation with positioning pin 9*c* projecting from the side face of cleaning frame 12*c* and fixed to the cleaning frame 12*c* with small screws 9*d*. Inside this flange 29 there is the stationary drum shaft 7*a* for rotatably supporting a spur gear 25*b* fitted in the photosensitive drum 7 (see FIG. 17). The cylindrical guide 9*a*L and this drum shaft 7*a* are arranged coaxially. The flange 29, cylindrical guide 9*a*L, and drum shaft 7*a* are made as an integral member or as incorporated members of a metal material, e.g., an iron material.

Figure 12:
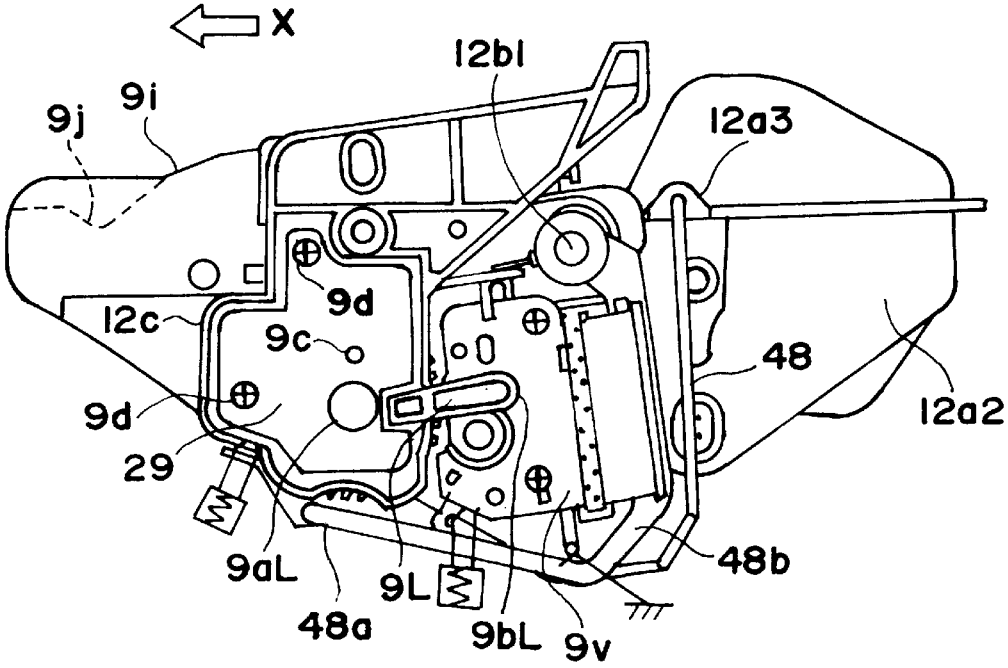
FIG. 12 is a left side view of the process cartridge shown in FIG. 9.
Figure 13:
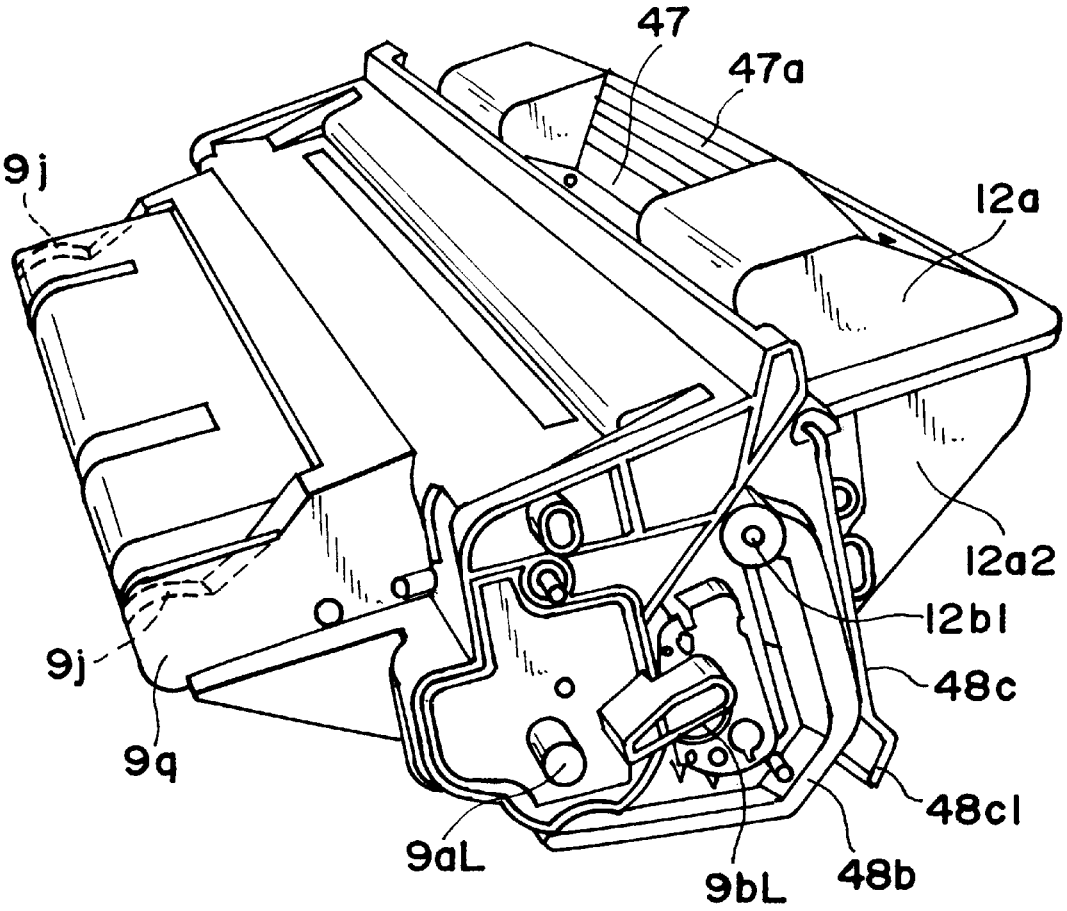
FIG. 13 is a perspective view of appearance as a view from the upper left of the process cartridge shown in FIG. 9.
Figure 14:
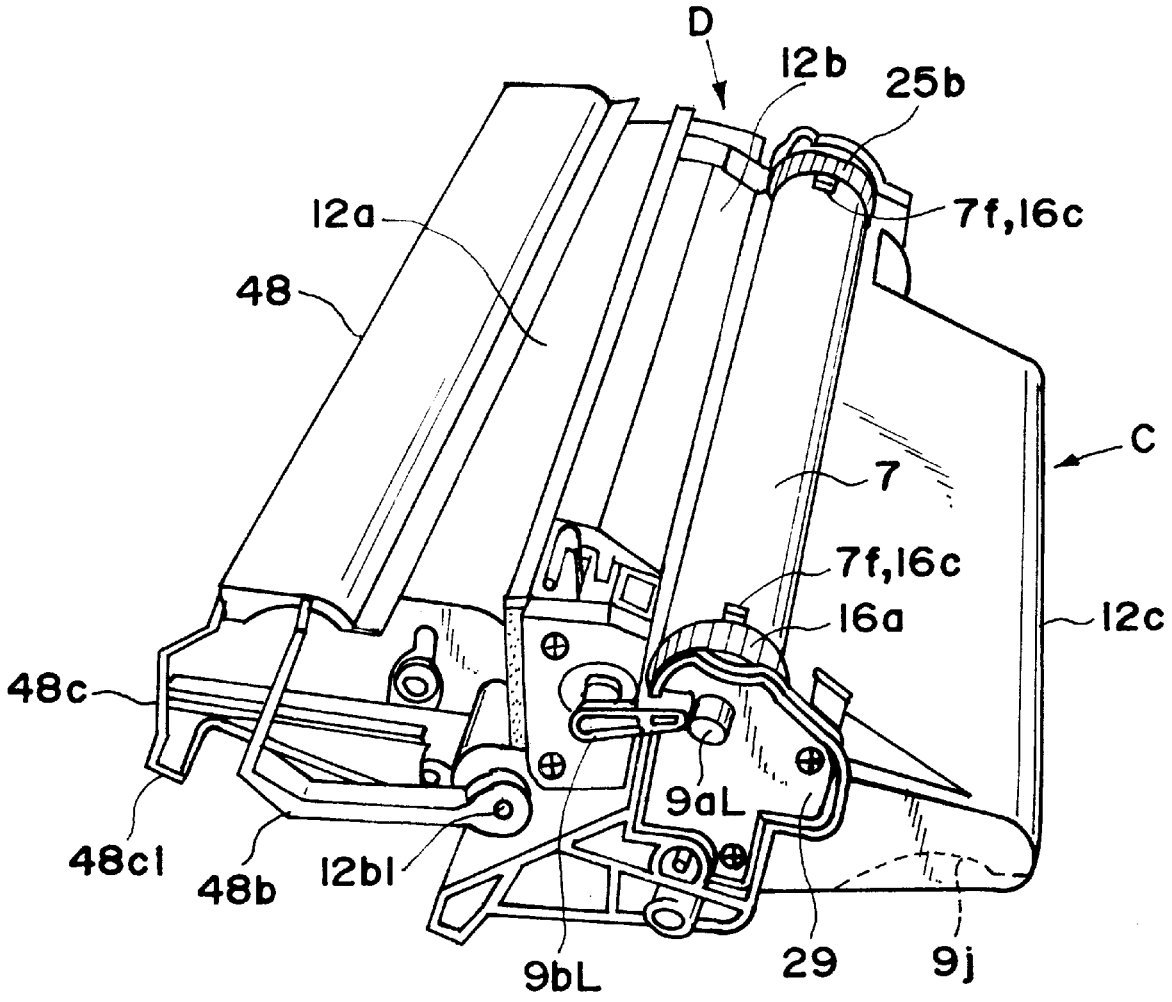
FIG. 14 is a perspective view of appearance for showing the lower left side of the process cartridge shown in FIG. 9.

As shown in FIG. 12, the locking guide 9*b*L is located a little apart from the cylindrical guide 9*a*L and is elongated almost in a radial direction of the cylindrical guide 9*a*L. The locking guide 9*b*L is molded as integral with the cleaning frame 12*c* so as to project from the cleaning frame 12*c* on the side. A part of flange 29 that could otherwise interfere with the locking guide 9*b*L is cut away and the height of projection of this locking guide 9*b*L on the side is determined so that the top face is almost coincident with the top face of the locking guide 9*b*L. This locking guide 9*b*L projects to the side of developing roller bearing box 9*v* fixed to the developing frame 12*b*. As described, the left guide member 9L is comprised of the separate members, i.e., the metal cylindrical guide 9*a*L and the plastic locking guide 19*b*L.

Described next are regulation contact portions 9*j* provided in the upper surface 9*i* of cleaning unit C. The upper surface herein means a surface located up when the process cartridge B is mounted in the image forming main body 13.

In the present embodiment, each regulation contact portion 9*j* is provided on either of the right end 9*p* and the left end 9*q* in a direction perpendicular to the mounting direction of process cartridge in the upper surface 9*i* of cleaning unit C as shown in FIG. 10 to FIG. 13. The regulation contact portions 9*j* are for determining the position of the process cartridge B when the process cartridge B is mounted in the image forming main body 13. Specifically, when the process cartridge B is mounted in the image forming main body 13, the regulation contact portions 9*j* come to contact fixed members 26 (see FIG. 15 and FIG. 16) provided on the image forming main body 13, whereby the process cartridge B is regulated in the position of rotation about the cylindrical guides 9*a*R, 9*a*L.

Described next is the guide means on the image forming main body 13 side. When an open/close cover 14 of the image forming main body 13 is rotated counterclockwise in FIG. 7 about shaft 14*a,* the top part of image forming main body 13 is opened to expose the mounting portion of process cartridge B as shown in FIG. 15 and FIG. 16. Each of guide members 15 (15R, 15L) is provided on the left side as shown in FIG. 15 or on the right side as shown in FIG. 16 when viewed along the mounting/dismounting direction of process cartridge B through the aperture with the open/close cover 14 open, in the left and right inner walls of the image forming main body 13.

As illustrated, each guide member 15 is provided with a guide portion 15*a,* 15*c* inclined forward down when viewed along the arrow X, which is the direction of insertion of the process cartridge B. Further, each guide member 15 is provided with a semicircular positioning U-groove 15*b,* 15*d,* connected to the guide portion 15*a*, 15*c,* for the cylindrical guide 9*a*R, 9*a*L of the process cartridge B to be fitted therein. The lower peripheral wall of this U-groove 15*b,* 15*d* is semicircular. The center of this U-groove 15*b,* 15*d* does not coincide with a center line connecting the centers of cylindrical guides 9*a*R, 9*a*L of process cartridge B when the process cartridge B is mounted in the main body 13. Specifically, the cylindrical guide 9*a*L is just fitted in the U-groove 15*b,* so that the position of photosensitive drum 7 is determined on the non-driven side; but, when the cylindrical guide 9*a*R is fitted into the U-groove 15*d,* the cylindrical guide 9*a*R is simply supported and is moved away from the U-groove 15*d* because of the aligning action of the shaft coupling described below.

The guide portions 15*a,* 15*c* have a width for the cylindrical guides 9*a*R, 9*a*L to be freely fitted therein in the view along the mounting/dismounting direction of the process cartridge B. The locking guides 9*b*R, 9*b*L, which have a width smaller than the diameter of cylindrical guides 9*a*R, 9*a*L, are loosely fitted in the guide portions, of course. However, the cylindrical guides 9*a*R, 9*a*L and locking guides 9*b*R, 9*b*L are restricted from rotating by the guide portions 15*a*, 15*c,* whereby the process cartridge B can be mounted in keeping its posture in a certain range. In the state wherein the process cartridge B is mounted in the image forming main body 13, the cylindrical guides 9*a*R, 9*a*L of the process cartridge B are fitted in the respective positioning grooves 15*b,* 15*d* of the guide members 15R, 15L. The left and right regulation contact portions 9*j* at the fore end of cleaning frame 12*c* of process cartridge B come to contact the fixed members 26 of the main body 13.

The process cartridge B described above is constructed in such a weight balance between the cleaning unit C side and the developing unit D side with respect to the center line connecting the centers of the cylindrical guides 9*a*R, 9*a*L that the developing unit D side has a greater static moment than the cleaning unit C side with the center line being kept horizontal.

When the process cartridge B is mounted into the image forming main body 13, the operator grasps ribs 47*a* on the recess 47 side and the lower side of the toner frame 12*a* by one hand. Then the operator inserts the cylindrical guides 9*a*R, 9*a*L into the respective guide portions 15*a,* 15*c* of the cartridge mounting portion of the image forming main body 13. Then, keeping the process cartridge B front down when seen in the insertion direction, the operator inserts the locking guides 9*b*R, 9*b*L into the guide portions 15*a*, 15*c* of the image forming main body 13. On that occasion, the cylindrical guides 9*aR*, 9*a*L and the locking guides 9*b*R, 9*b*L of the process cartridge B move into the deep inside along the guide portions 15*a*, 15*c* of the image forming main body 13. After that, when the cylindrical guides 9*a*R, 9*a*L of the process cartridge B reach the positioning grooves 15*b,* 15*d* of the image forming main body 13, the cylindrical guides 9*a*R, 9*a*L are seated at the positions of the positioning grooves 15*b*, 15*d* by gravity on the process cartridge B. Since the center line connecting the centers of the cylindrical guides 9*a*R, 9*a*L is that of the photosensitive drum 7, the photosensitive drum 7 is roughly positioned relative to the image forming main body 13. The photosensitive drum 7 is finally positioned relative to the main body 13 when the shaft coupling is made.

In this state a small gap exists between the fixed members 26 of the image forming main body 13 and the regulation contact portions 9*j* of the process cartridge B. When the process cartridge B is released from the hand keeping it, the process cartridge B moves so that the developing unit D side descends while the cleaning unit C side ascends, about the cylindrical guides 9*a*R, 9*a*L. As a result, the regulation contact portions 9*j* of the process cartridge B come to contact the fixed members 26 of the image forming main body 13, whereby the process cartridge B is positioned relative to the image forming main body 13. After that, the open/close cover 14 is closed by rotating it clockwise about the shaft 14*a* in FIG. 7.

The removing operation of the process cartridge B from the main body 13 is reverse to the above operation. The operator opens the open/close cover 14 of the main body 13 and captures the aforementioned upper and lower ribs 47*a* of the grip part of the process cartridge B to lift the cartridge. Then the cylindrical guides 9*a*R, 9*a*L of the process cartridge B rotate about the positioning grooves 15*b,* 15*d* of the main body 13, so that the regulation contact portions 9*j* of the process cartridge B are moved away from the fixed members 26 of the main body 13. By further pulling the process cartridge B up, the cylindrical guides 9*a*R, 9*a*L leave the positioning grooves 15*b,* 15*d* and move into the guide portions 15*a,* 15*c* of the guide members 15R, 15L fixed in the main body 13. Lifting the process cartridge B as it is, the cylindrical guides 9*a*R, 9*a*L and the locking guides 9*b*R, 9*b*L of the process cartridge B move up in the guide portions 15*a*, 15*c* of the main body 13. This permits the process cartridge B to be taken out of the main body 13 without hitting the other portions of the main body 13, while being regulated in the posture of process cartridge B.

As shown in FIG. 18, the spur gear 25*b* is provided at the end on the opposite side to the helical gear 16*a* in the axial direction of the photosensitive drum 7. When the process cartridge B is mounted in the main body 13, the spur gear 25*b* meshes with a gear (not illustrated) coaxial with the transfer roller 4 provided in the main body 13, thereby transmitting the driving force for rotating the transfer roller 4 from the process cartridge B.

(Shaft coupling and drive configuration)

Described next is the configuration of the shaft coupling device which is a drive transmission mechanism from the image forming main body 13 to the process cartridge B.

As shown in FIG. 17, a cartridge-side shaft joint member is provided at one longitudinal end of the photosensitive drum 7 mounted in the process cartridge B. This shaft coupling member is constructed by giving a coupling projection shaft 17 (of a cylindrical shape) to the drum flange 16 fixed to one end of the photosensitive drum 7. A projecting portion 17*a* is formed in the tip face of the coupling projection shaft 17. This coupling projection shaft 17 is fitted in bearing 24, thereby functioning as a drum rotation shaft. In the present embodiment the gear flange 16 is integral with the coupling projection shaft 17 and projecting portion 17*a*. The gear flange 16 is provided with the integral helical gear 16*a*, for transmitting the driving force to the developing roller 10*d* inside the process cartridge B. Therefore, the drum flange 16 is an integrally molded member having the fitting portion 16*b* to the drum cylinder 7*d*, the helical gear 16*a*, the coupling projection shaft 17, and the projecting portion 17*a*, which is a driving force transmitting part having the function to transmit the driving force.

The projecting portion 17*a* is a projection of a shape of a twisted regular triangle prism. A depressed portion 18*a* to be fitted with the projecting portion 17*a* is a hole gradually twisted along the axial direction, having a cross section of generally a regular triangle. This depressed portion 18*a* is arranged to be rotated together with a large gear 34 provided in the main body 13. In the configuration of the present embodiment, when the process cartridge B is mounted in the main body 13 so as to fit the projecting portion 17*a* with the depressed portion 18*a* provided in the main body 13 and when the rotational force of the depressed portion 18*a* is transmitted to the projected portion 17*a*, the ridges of the projecting portion 17*a* equally contact the respective internal faces of the depressed portion 18*a*, which matches the shaft centers thereof with each other. Further, the gradually axially twisted configuration of the depressed portion 18*a* functions to generate a force in such a direction that the depressed portion 18*a* pulls the projecting portion 17*a*, whereby the end face of the projecting portion 17*a* comes to contact the bottom face of the depressed portion 18*a*. Thus, the photosensitive drum 7 integral with the projecting portion 17*a* is stably positioned in the axial direction and in the radial direction within the image forming main body 13.

The drum flange 25 is fixed on the other end side of the photosensitive drum 7. The spur gear 25*b* is molded as integral with the drum flange 25 (see FIG. 17). This drum flange 25 is rotatably fitted with the drum shaft 7*a* integral with the flange 29 fixed to the cleaning frame 12*c*.

When the process cartridge B is mounted in the main body 13, the cylindrical guide 9*a*L concentric with the drum shaft 7*a* is fitted in the U-groove 15*b* (see FIG. 15) of the main body 13 to be positioned. The spur gear 25*b* integrally molded with the drum flange 25 comes to be coupled with the gear (not illustrated) for transmitting the driving force to the transfer roller 4.

Figure 10:
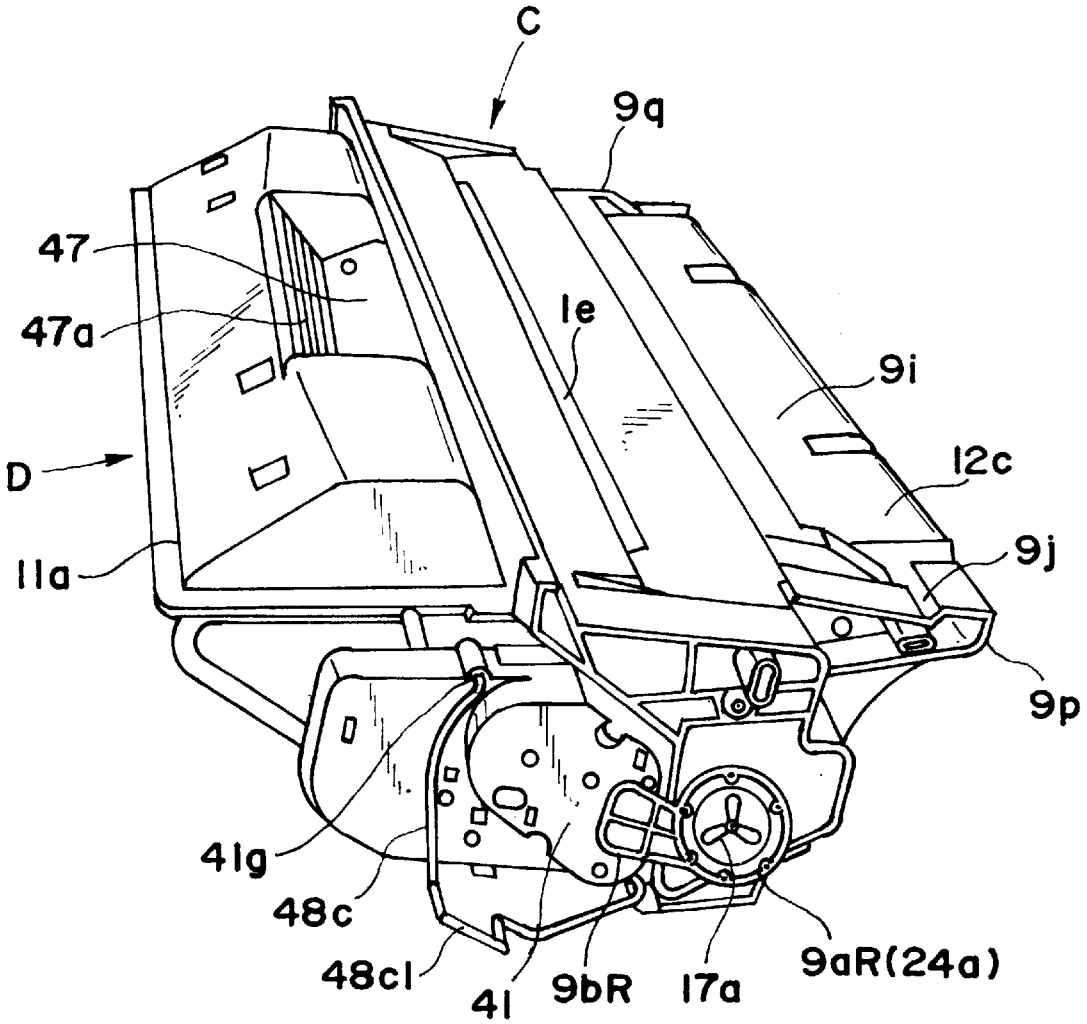
FIG. 10 is a perspective view of appearance as a view from the upper right of the process cartridge shown in FIG. 9.
Figure 11:
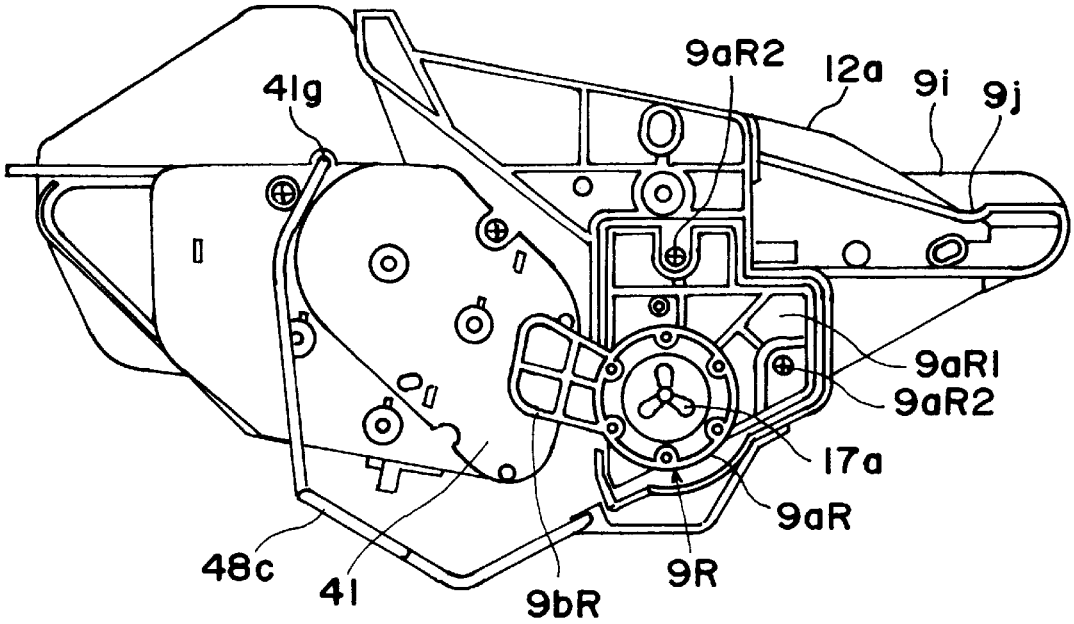
FIG. 11 is a right side view of the process cartridge shown in FIG. 9.

Around the projecting portion 17*a* of the coupling projection shaft 17 of the process cartridge B, the cleaning frame 12*c* is provided with a hollow cylindrical boss 24*a* concentric with the projection shaft 17 (see FIG. 10 and FIG. 17). This boss 24*a* protects the coupling projection portion 17*a* upon mounting/dismounting of the process cartridge B, for example, from a flaw or deformation due to external force. This can thus prevent rattle or vibration upon coupling drive due to damage of the projection portion 17*a*.

The material for the drum flanges 16, 25 is selected from resin materials such as polyacetal, polycarbonate, polyamide, and polybutyleneterephthalate. The material may be selected from other materials as the occasion may demand.

In the present embodiment the drum flange 25 is engaged with the drum shaft 7*a* provided in the cleaning frame 12*c* (see FIG. 17). In addition, the coupling projection shaft 17 is fitted to the internal face of bearing 24 attached to the cleaning frame 12*c*. In this state the photosensitive drum 7 is mounted in the cleaning frame 12*c* of the process cartridge B. Therefore, the photosensitive drum 7 rotates about the coupling projection shaft 17 and the drum shaft 7*a*.

The large gear 34 on the main body 13 side is a helical gear. This helical gear has teeth with such inclination directions and angles that thrust to move the coupling depression shaft 18 toward the projection shaft 17 is generated when the driving force is transmitted from small helical gear 20 fixed to shaft 30*a* of motor 30 shown in FIG. 17. In this configuration, when the motor 30 is driven upon formation of image, the thrust moves the coupling depression shaft 18 toward the projection shaft 17 to help engagement between the depressed portion 18*a* and the projecting portion 17*a*.

The present embodiment employs the configuration for making the depressed portion 18*a* engaged with the projecting portion 17*a* in synchronization with the closing operation of the open/close cover 14 (the description of which is omitted herein).

What is claimed is:

1. A cylindrical member used in an electrophotographic image forming apparatus, comprising:

a metallic cylinder having a thin portion of a small thickness at a longitudinal end thereof, the thin portion having an external diameter smaller than that of another portion of said metallic cylinder in the longitudinal direction thereof; and an engaging member having a fit portion fitted to an internal surface of the thin portion of said cylinder;

wherein said engaging member is engaged with said metallic cylinder by bending the thin portion of said cylinder toward the fit portion, wherein the fit portion of said engaging member is fitted to the internal surface over both of the thin portion and the another portion.

2. A cylindrical member according to claim 1, wherein said thin portion is made by forming a step in the end of said cylinder.

3. A cylindrical member according to claim 1, wherein said thin portion is provided throughout the entire circumference of a peripheral edge of said cylinder.

4. A cylindrical member according to either one of claims 1 to 3, wherein said thin portion is cut and bent to be fitted in the depressed portion of said engaging member.

5. A cylindrical member according to claim 1, wherein said cylinder has the thin portion made by forming a groove in the outside of the end thereof.

6. A cylindrical member according to claim 5, wherein said thin portion is cut and bent at the root of a bottom part of said groove to be fitted in the depressed portion of said engaging member.

7. A cylindrical member according to claim 4, wherein said cylinder is of a metal material having plasticity.

8. A cylindrical member according to claim 4, wherein said engaging member is of a synthetic resin material.

9. A cylindrical member according to claim 1, wherein said cylindrical member is an electrophotographic photosensitive drum having a photosensitive layer on an outside peripheral surface of said cylinder.

10. A cylindrical member according to claim 1, wherein said cylindrical member is an electrophotographic photosensitive drum having a photosensitive layer on an outside peripheral surface of said cylinder, used in a process cartridge capable of being mounted or dismounted with respect to the main body of the electrophotographic image forming apparatus.

11. A cylindrical member according to claim 1, wherein said cylindrical member is a developing roller for conveying toner by depositing the toner on an outside peripheral surface of said cylinder.

12. A cylindrical member according to claim 1, wherein said cylindrical member is a developing roller for conveying toner by depositing the toner on an outside peripheral surface of said cylinder, used in a process cartridge capable of being removably mounted with respect to the main body of the electrophotographic image forming apparatus.

13. An electrophotographic photosensitive drum used in an electrophotographic image forming apparatus, comprising:

a metallic cylinder having a photosensitive layer on an outside peripheral surface thereof, said cylinder having a thin portion of a smaller thickness at a longitudinal end thereof than a portion having said photosensitive layer, the thin portion having an external diameter smaller than that of another portion of said metallic cylinder in the longitudinal direction thereof; and an engaging member having a fit portion fitted to an internal surface of the thin portion;

wherein said engaging member is engaged with said metallic cylinder by bending the thin portion of said metallic cylinder toward said fit portion, wherein the fit portion of said engaging member is fitted to the internal surface over both of the thin portion and the another portion.

14. An electrophotographic photosensitive drum according to claim 13, wherein said thin portion is made by forming a step in the end of said cylinder.

15. An electrophotographic photosensitive drum according to claim 13, wherein said thin portion is provided throughout the entire circumference of a peripheral edge of said cylinder.

16. An electrophotographic photosensitive drum according to either one of claims 13 to 15, wherein said thin portion is cut and bent to be fitted in the depressed portion of said drum flange.

17. An electrophotographic photosensitive drum according to claim 16, wherein the thickness of said thin portion is preferably between 0.5 mm and 1.0 mm.

18. An electrophotographic photosensitive drum according to claim 17, wherein the thickness of said thin portion is more preferably between 0.6 mm and 0.8 mm.

19. An electrophotographic photosensitive drum according to claim 13, wherein said cylinder has the thin portion made by forming a groove in the outside of the end thereof.

20. An electrophotographic photosensitive drum according to claim 19, wherein said thin portion is cut and bent at the root of a bottom part of said groove to be fitted in the depressed portion of said drum flange.

21. An electrophotographic photosensitive drum according to claim 18, wherein said cylinder is of a metal material having plasticity.

22. An electrophotographic photosensitive drum according to claim 18, wherein said drum flange is of a synthetic resin material.

23. An electrophotographic photosensitive drum according to claim 22, wherein said drum flange has a shaft for rotatably supporting said electrophotographic photosensitive drum, a projection for receiving driving force for rotation of said electrophotographic photosensitive drum from the main body is provided at the tip of said shaft, and said drum flange is an integrally molded member of a plastic material.

24. An electrophotographic photosensitive drum according to claim 13, wherein said electrophotographic photosensitive drum is used in a process cartridge capable of being removably mounted with respect to the main body of the electrophotographic image forming apparatus.

25. A developing roller used in an electrophotographic image forming apparatus, comprising:

a metallic cylinder for conveying toner by depositing the toner on an outside peripheral surface thereof, said cylinder having a thin portion of a smaller thickness at a longitudinal end thereof than a portion where the toner is deposited, the thin portion having an external diameter smaller than that of another portion of said metallic cylinder in the longitudinal direction thereof; and an engaging member having a fit portion fitted to an internal surface of the thin portion;

wherein said engaging member is engaged with said metallic cylinder by bending the thin portion of said cylinder toward said fit portion, wherein the fit portion of said engaging member is fitted to the internal surface over both of the thin portion and the another portion.

26. A developing roller according to claim 25, wherein said thin portion is made by forming a step in the end of said cylinder.

27. A developing roller according to claim 25, wherein said thin portion is provided throughout the entire circumference of a peripheral edge of said cylinder.

28. A developing roller according to either one of claims 25 to 27, wherein said thin portion is cut and bent to be fitted in the depressed portion of said roller flange.

29. A developing roller according to claim 28, wherein the thickness of said thin portion is preferably between 0.4 mm and 0.8 mm.

30. A developing roller according to claim 25, wherein said cylinder has the thin portion made by forming a groove in the outside of the end thereof.

31. A developing roller according to claim 30, wherein said thin portion is cut and bent at the root of a bottom part of said groove to be fitted in the depressed portion of said roller flange.

32. A developing roller according to claim 29, wherein said cylinder is of a metal material having plasticity.

33. A developing roller according to claim 29, wherein said roller flange is of a synthetic resin material.

34. A developing roller according to claim 25, wherein said developing roller is used in a process cartridge capable of being removably mounted with respect to the main body of the electrophotographic image forming apparatus.

35. A process cartridge capable of being mounted or dismounted with respect to the main body of an electrophotographic image forming apparatus, comprising:

(a) an electrophotographic photosensitive drum having:

a metallic cylinder having a photosensitive layer on an outside peripheral surface thereof, said cylinder having a thin portion of a smaller thickness at a longitudinal end thereof than a portion having said photosensitive layer, the thin portion having an external diameter smaller than that of another portion of said metallic cylinder in the longitudinal direction thereof; and an engaging member having a fit portion fitted to an internal surface of the thin portion of said cylinder;

wherein said engaging member is engaged with said cylinder by bending the thin portion of said cylinder toward said fit portion;

wherein the fit portion of said engaging member is fitted to the internal surface over both of the thin portion and the another portion; and (b) process means for acting on said electrophotographic photosensitive drum.

36. A process cartridge according to claim 35, wherein said thin portion is made by forming a step in the end of said cylinder.

37. A process cartridge according to claim 35, wherein said thin portion is provided throughout the entire circumference of a peripheral edge of said cylinder.

38. A process cartridge according to either one of claims 35 to 37, wherein said thin portion is cut and bent to be fitted in the depressed portion of said drum flange.

39. A process cartridge according to claim 38, wherein the thickness of said thin portion is preferably between 0.5 mm and 1.0 mm.

40. A process cartridge according to claim 39, wherein the thickness of said thin portion is more preferably between 0.6 mm and 0.8 mm.

41. A process cartridge according to claim 35, wherein said cylinder has the thin portion made by forming a groove in the outside of the end thereof.

42. A process cartridge according to claim 41, wherein said thin portion is cut and bent at the root of a bottom part of said groove to be fitted in the depressed portion of said drum flange.

43. A process cartridge according to claim 40, wherein said cylinder is of a metal material having plasticity.

44. A process cartridge according to claim 40, wherein said drum flange is of a synthetic resin material.

45. A process cartridge according to claim 44, wherein said drum flange has a shaft for rotatably supporting said electrophotographic photosensitive drum, a projection for receiving driving force for rotation of said electrophotographic photosensitive drum from the main body is provided at the tip of said shaft, and said drum flange is an integrally molded member of a plastic material.

46. A process cartridge capable of being removably mounted with respect to the main body of an electrophotographic image forming apparatus, comprising:

a developing roller having:

a metallic cylinder for conveying toner by depositing the toner on an outside peripheral surface thereof, said cylinder having a thin portion of a smaller thickness at a longitudinal end thereof than a portion on which the toner is deposited, the thin portion having an external diameter smaller than that of another portion of said metallic cylinder in the longitudinal direction thereof; and an engaging member having a fit portion fitted to an internal surface of the thin portion of said cylinder;

wherein said engaging member is engaged with said metallic cylinder by bending the thin portion of said cylinder toward said fit portion, wherein the fit portion of said engaging member is fitted to the internal surface over both of the thin portion and the another portion.

47. A process cartridge according to claim 46, wherein said thin portion is made by forming a step in the end of said cylinder.

48. A process cartridge according to claim 46, wherein said thin portion is provided throughout the entire circumference of a peripheral edge of said cylinder.

49. A process cartridge according to either one of claims 46 to 48, wherein said thin portion is cut and bent to be fitted in the depressed portion of said roller flange.

50. A process cartridge according to claim 49, wherein the thickness of said thin portion is preferably between 0.4 mm and 0.8 mm.

51. A process cartridge according to claim 46, wherein said cylinder has the thin portion made by forming a groove in the outside of the end thereof.

52. A process cartridge according to claim 51, wherein said thin portion is cut and bent at the root of a bottom part of said groove to be fitted in the depressed portion of said roller flange.

53. A process cartridge according to claim 50, wherein said roller flange is of a metal material having plasticity.

54. A process cartridge according to claim 50, wherein said roller flange is of a synthetic resin material.

55. A process cartridge according to claim 35 or 46, wherein said process cartridge is a cartridge integrally comprising said electrophotographic photosensitive drum and at least one, as process means, of charging means for charging said electrophotographic photosensitive drum, developing means for developing a latent image formed on said electrophotographic photosensitive drum, and cleaning means for removing toner remaining on said electrophotographic photosensitive drum, said process cartridge being capable of being removably mounted with respect to the main body of said electrophotographic image forming apparatus.

56. A method for forming a cylindrical member used in an electrophotographic image forming apparatus, comprising:

a first step of forming a thin portion of a metallic cylinder at a longitudinal end thereof, the thin portion having a small thickness at a longitudinal end thereof, the thin portion having an external diameter smaller than that of another portion of said metallic cylinder in the longitudinal direction thereof;

a second step of forming a fit portion of an engaging portion, fitted to an internal surface of the thin portion; and a third step of engaging said engaging member with said metallic cylinder by bending the thin portion of the cylinder toward the fit portion, wherein said third step further comprises the step of fitting the fit portion of the engaging member to the internal surface over both of the thin portion and the another portion.

57. A method according to claim 56, wherein in the first step said thin portion is made by forming a step in the end of said cylinder.

58. A method according to claim 56, wherein in the first step said thin portion is provided throughout the entire circumference of a peripheral edge of said cylinder.

59. A method according to claim 56, wherein in the third step said thin portion is cut and bent to be fitted in the depressed portion of said engaging member.

60. A method according to claim 56, wherein in the first step the thin portion is made by forming a groove in the outside of the end of the cylinder.

61. A method according to claim 60, wherein in the third step said thin portion is cut and bent at the root of a bottom part of said groove to be fitted in the depressed portion of said engaging member.

62. A method according to claim 59, further comprising a step of making said cylinder of a metal material having plasticity.

63. A method according to claim 59, further comprising a step of making said engaging member of a synthetic resin material.

* * * * *

UNITED STATES PATENT AND TRADEMARK OFFICE

CERTIFICATE OF CORRECTION

PATENT NO. : 5,991,571

DATED : November 23, 1999

INVENTOR(S) : Yusuke YAMADA, et al.

It is certified that error appears in the above-identified patent and that said Letters Patent is hereby corrected as shown below:

COLUMN 1:

Line 23, "members" should read --members,--.

COLUMN 5:

Line 6, "foregoing" should read --foregoing has--.

COLUMN 8:

Line 31, "Specific" should read --¶Specific--.

UNITED STATES PATENT AND TRADEMARK OFFICE

CERTIFICATE OF CORRECTION

PATENT NO. : 5,991,571

DATED : November 23, 1999

INVENTOR(S) : Yusuke YAMADA, et al.

It is certified that error appears in the above-identified patent and that said Letters Patent is hereby corrected as shown below:

COLUMN 9:

Line 12, "the" should read --a--.
Line 13, "the" (both occurrences) should read --a--; and "32.5°" should read -- of 32.5°--.
Line 14, "humidity" should read --humidity of--.
Line 17, "the" (first occurrence) should be deleted.
Line 21, "at" should read --effects were not present at--.
Line 42, "thickness:" should read --thickness--.

COLUMN 11:

Line 35, "Then" should read --Then,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*